US008559846B2

(12) United States Patent
Okabe et al.

(10) Patent No.: US 8,559,846 B2
(45) **Date of Patent: *Oct. 15, 2013**

(54) PHOTOSENSITIVE-MEMBER UNIT AND IMAGE FORMING APPARATUS

(75) Inventors: Yasushi Okabe, Nagoya (JP); Yoshiya Tomatsu, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/238,683

(22) Filed: Sep. 21, 2011

(65) Prior Publication Data

US 2012/0008983 A1 Jan. 12, 2012

Related U.S. Application Data

(63) Continuation of application No. 12/820,765, filed on Jun. 22, 2010, now Pat. No. 8,045,883, which is a continuation of application No. 12/417,285, filed on Apr. 2, 2009, now Pat. No. 7,769,320, which is a continuation of application No. 11/642,787, filed on Dec. 21, 2006, now Pat. No. 7,522,858.

(30) Foreign Application Priority Data

Dec. 27, 2005 (JP) ..... P2005-376118

(51) Int. Cl.
*G03G 15/00* (2006.01)
*G03G 21/16* (2006.01)
*G03G 21/18* (2006.01)

(52) U.S. Cl.
USPC ..... 399/110; 399/111; 399/112; 399/117

(58) Field of Classification Search
USPC ..... 399/107, 110, 111, 112, 116, 117
See application file for complete search history.

(56) References Cited

U.S. PATENT DOCUMENTS 6,498,915 B2 12/2002 Yamaguchi et al.
6,708,011 B2 3/2004 Nomura et al.

(Continued)

FOREIGN PATENT DOCUMENTS

EP 1273980 A 1/2003
EP 1331525 A2 7/2003

(Continued)

OTHER PUBLICATIONS

EP Search Report dtd Jan. 29, 2008, EP Appln. 06026479.

(Continued)

*Primary Examiner* — Sandra Brase
(74) *Attorney, Agent, or Firm* — Banner & Witcoff, Ltd.

(57) ABSTRACT

A pressing member applies a pressing force to a trailing end in a direction which intersects a predetermined reference direction, allowing the pressing force to have both a first component in the predetermined reference direction and a second component perpendicular to the predetermined reference direction. A trailing end is pressed in the predetermined reference direction by the first component. In the mounted state, the leading end is in contact with the reference member at two contact surfaces including a first contact surface and a second contact surface. The first contact surface defines a first positioning direction being perpendicular to the first contact surface and intersecting the predetermined reference direction. The second contact surface defines a second positioning direction being perpendicular to the second contact surface and intersecting both the predetermined reference direction and the first positioning direction, allowing the photosensitive-member unit to be positioned with respect to the main body.

5 Claims, 11 Drawing Sheets

(56) References Cited

U.S. PATENT DOCUMENTS

| | | | | |
|---|---|---|---|---|
| 6,980,758 | B2 | 12/2005 | Murayama et al. | |
| 7,272,341 | B2 | 9/2007 | Jung et al. | |
| 7,522,858 | B2 | 4/2009 | Okabe et al. | |
| 7,769,320 | B2 | 8/2010 | Okabe et al. | |
| 8,045,883 | B2 * | 10/2011 | Okabe et al. | 399/110 |
| 2003/0165346 | A1 | 9/2003 | Yamaguchi et al. | |
| 2004/0136747 | A1 | 7/2004 | Tanizaki et al. | |
| 2004/0165910 | A1 | 8/2004 | Sato et al. | |
| 2005/0265746 | A1 | 12/2005 | Jung et al. | |

FOREIGN PATENT DOCUMENTS

| | | | |
|---|---|---|---|
| JP | 2003-015378 | A | 1/2003 |
| JP | 2005-091792 | A | 4/2005 |
| JP | 2005-107139 | A | 4/2005 |

OTHER PUBLICATIONS

JP Office Action dtd Nov. 13, 2008, JP Appln. 2005-376118, English translation.

* cited by examiner

PHOTOSENSITIVE-MEMBER UNIT AND IMAGE FORMING APPARATUS

CROSS REFERENCE TO RELATED APPLICATIONS

This application is a continuation of U.S. application Ser. No. 12/820,765, filed Jun. 22, 2010, which is a continuation of U.S. application Ser. No. 12/417,285, filed Apr. 2, 2009, now U.S. Pat. No. 7,769,320, issued Aug. 3, 2010, which is a continuation of U.S. application Ser. No. 11/642,787, filed Dec. 21, 2006, now U.S. Pat. No. 7,522,858, issued Apr. 21, 2009, which claims priority from Japanese Patent Application No. 2005-376118 filed Dec. 27, 2005, the entire contents of which are incorporated herein by reference.

TECHNICAL FIELD

The disclosure relates to a photosensitive-member unit and an image forming apparatus.

BACKGROUND

U.S. Pat. No. 6,708,011 (corresponding to Japanese Patent Application Publication No. 2003-015378) discloses a color image forming apparatus including a photosensitive member cartridge having four photosensitive members, a corona charger arranged around the four photosensitive members, and a cleaning device, all making up an integral unit. The photosensitive member cartridge is pulled and removed from the apparatus main body and is mounted into the apparatus main body, while a developing unit attached to each photosensitive member is detachably mountable relative to the photosensitive member cartridge.

SUMMARY

In such a color image forming apparatus, while an exposure unit is fixed to the apparatus main body, the photosensitive member cartridge in which the four photosensitive members are integrally provided can be detachably pulled out of the apparatus main body and can be detachably mounted on the apparatus main body. Hence, while the photosensitive member cartridge is in a state of being mounted on the apparatus main body, accurate positioning of the photosensitive member cartridge in relation to the apparatus main body is required, so that an accurate arrangement of each photosensitive member relative to the exposure unit may be established.

Especially, if the arrangement of each photosensitive member relative to the exposure unit suffers variations of each photosensitive member, deviations (errors) occur in superimposing each color, thus causing defective color images.

In view of the foregoing, it is an object of one aspect of the invention to provide an image forming apparatus which can render accurate positioning of a photosensitive-member unit in relation to a main body of an image forming apparatus through a simple construction, and a photosensitive-member unit which can be detachably mounted on the image forming apparatus.

In order to attain the above and other objects, the invention provides an image forming apparatus. The image forming apparatus includes a main body and a photosensitive-member unit detachably mounted on the main body. The main body includes a casing, a reference member fixed at a reference position in the casing, and a pressing member provided at the casing and configured to generate a pressing force. The photosensitive-member unit has a leading end and a trailing end with respect to a mounting direction for mounting the photosensitive-member unit on the main body. The photosensitive-member unit includes a plurality of photosensitive members provided for each of a plurality of colors. The plurality of photosensitive members is arranged in a predetermined reference direction. Each of the plurality of photosensitive members is rotatable about respective ones of a plurality of rotational axes each extending in an axial direction. The pressing member applies the pressing force to the trailing end in a pressing direction when the photosensitive-member unit is in a mounted state. The pressing direction intersects the predetermined reference direction, allowing the pressing force to have both a first component in the predetermined reference direction and a second component in a direction perpendicular to the predetermined reference direction. The trailing end is pressed in the predetermined reference direction by the first component. In the mounted state, the leading end is in contact with the reference member at two contact surfaces including a first contact surface and a second contact surface. The first contact surface defines a first positioning direction that is perpendicular to the first contact surface and that intersects the predetermined reference direction. The second contact surface defines a second positioning direction that is perpendicular to the second contact surface and that intersects both the predetermined reference direction and the first positioning direction, allowing the photosensitive-member unit to be positioned with respect to the main body.

According to another aspect, the invention also provides a photosensitive-member unit configured to be detachably mounted on a main body of an image forming apparatus. The photosensitive-member unit has a leading end and a trailing end with respect to a mounting direction for mounting the photosensitive-member unit on the main body. The photosensitive-member unit includes a plurality of photosensitive-member holding units and a pair of side plates. The plurality of photosensitive-member holding units holds respective ones of a plurality of photosensitive members individually. The plurality of photosensitive members is arranged in a predetermined reference direction. The plurality of photosensitive members is rotatable about respective ones of a plurality of rotational axes each extending in an axial direction. The pair of side plates sandwiches the arranged plurality of photosensitive-member holding units from both sides in the axial direction. The trailing end is pressed in a pressing direction when the photosensitive-member unit is in a mounted state. The pressing direction intersects the predetermined reference direction, allowing the pressing force to have both a first component in the predetermined reference direction and a second component in a direction perpendicular to the predetermined reference direction. The trailing end is pressed in the predetermined reference direction by the first component. In the mounted state, the leading end is configured to be in contact with the main body at two contact surfaces including a first contact surface and a second contact surface. The first contact surface defines a first positioning direction that is perpendicular to the first contact surface and that intersects the predetermined reference direction. The second contact surface defines a second positioning direction that is perpendicular to the second contact surface and that intersects both the predetermined reference direction and the first positioning direction, allowing the photosensitive-member unit to be positioned with respect to the main body.

BRIEF DESCRIPTION OF THE DRAWINGS

Illustrative aspects in accordance with the invention will be described in detail with reference to the following figures wherein.

DETAILED DESCRIPTION

A photosensitive-member unit and an image forming apparatus according to some aspects of the invention will be described while referring to the accompanying drawings.

In the following description, the expressions "front", "rear", "upper", "lower", "right", and "left" are used to define the various parts when the image forming apparatus is disposed in an orientation in which it is intended to be used.

1. General Structure of a Color Laser Printer

Figure 1:
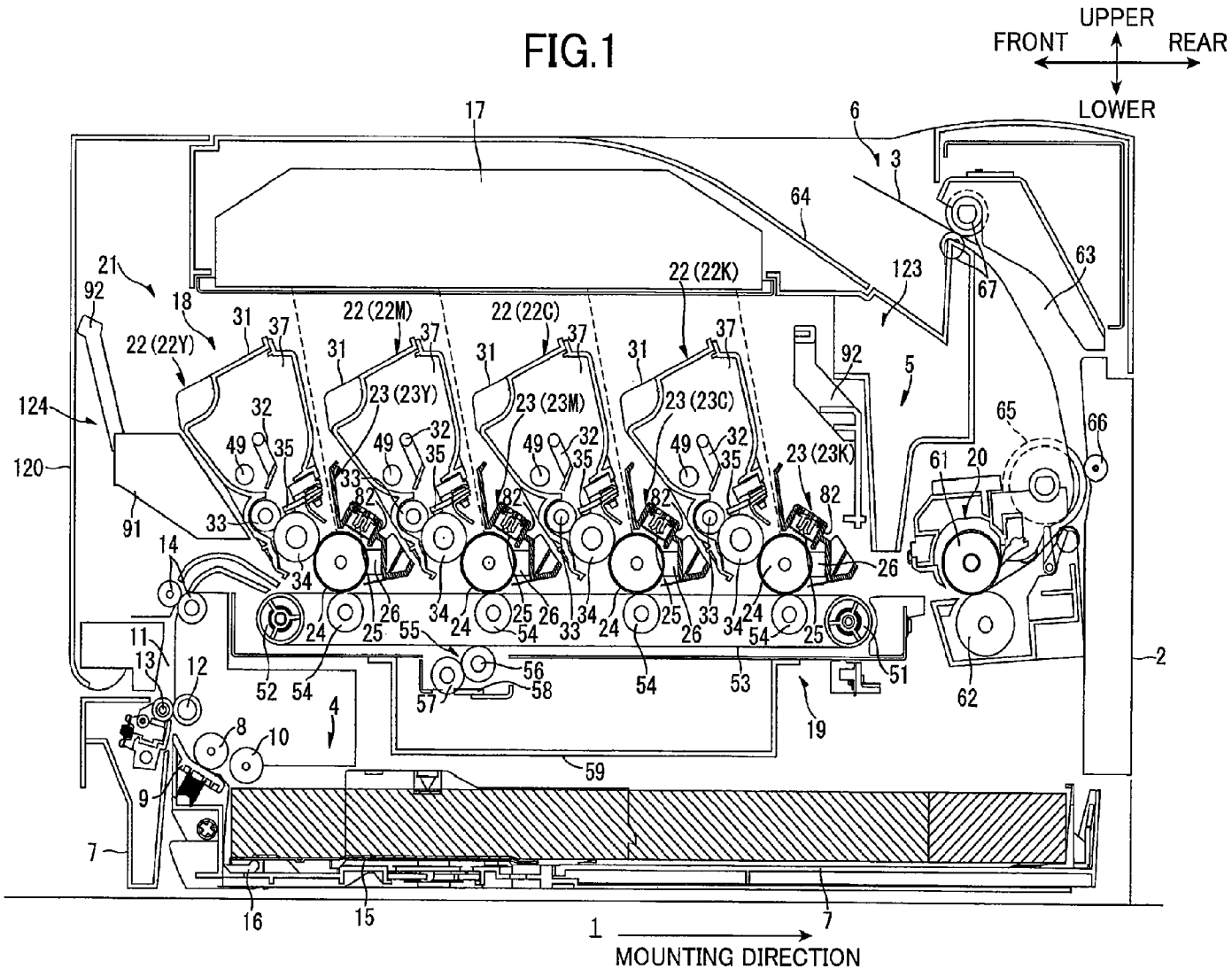
FIG. 1 is a side cross-sectional view of the relevant parts of a color laser printer according to illustrative aspects of the invention.

As shown in FIG. 1, a color laser printer 1 is a horizontal tandem-type printer having a plurality of drum subunits 23 juxtaposed in a horizontal direction. The printer 1 includes a main casing 2 and, within the main casing 2, a feeding unit 4 for supplying sheets of a paper 3, an image-forming unit 5 for forming images on the paper 3 supplied from the feeding unit 4, and a discharge unit 6 for discharging the paper 3 after an image has been formed thereon.

In the following description, the left side of the printer 1 in FIG. 1 (the side of the main casing 2 in which a drum access opening 124 is formed) will be referred to as the "front side," while the right side of the printer 1 in FIG. 1 will be referred to as the "rear side." Further, the near side in FIG. 1 with respect to the paper width direction will be referred to as the "right side," while the far side in FIG. 1 will be referred to as the "left side."

Unless otherwise stated below, directions in the following description of a drum unit 21 and developer cartridges 22 will conform to the state in which the drum unit 21 and developer cartridges 22 are mounted in the main casing 2.

(1) Feeding Unit

The feeding unit 4 includes a paper tray 7 for accommodating the paper 3 that can be slid into or removed from a lower section of the main casing 2 in a front-to-rear direction; a separating roller 8 and a separating pad 9 disposed above a front end of the paper tray 7 and in confrontation with each other; and a feeding roller 10 disposed on the rear side of the separating roller 8.

The feeding unit 4 includes a feeding-end paper-conveying path 11 for guiding the paper 3 conveyed from the paper tray 7. The feeding-end paper-conveying path 11 is substantially U-shaped in a side view for initially guiding the paper 3 forward and subsequently reversing directions toward the rear. The feeding-end paper-conveying path 11 has an upstream end positioned on the lower side of the U-shape adjacent to the separating roller 8, and a downstream end positioned on the upper side of the U-shape adjacent to a conveying belt 53 described later.

The feeding unit 4 also includes a paper dust roller 12 and a pinch roller 13 disposed in confrontation with each other along the feeding-end paper-conveying path 11 and positioned above and forward of the separating roller 8; and a pair of registration rollers 14 also disposed on the feeding-end paper-conveying path 11 above the paper dust roller 12 and pinch roller 13.

A paper-pressing plate 15 is provided inside the paper tray 7 for supporting the paper 3 in a stacked state. The paper-pressing plate 15 is pivotably supported on the rear end thereof, so that the front end can pivot downward to a resting position in which the paper-pressing plate 15 rests on a bottom plate of the paper tray 7 and can pivot upward to a feeding position in which the paper-pressing plate slopes upward from the rear end to the front end.

A lever 16 is provided in the lower front section of the paper tray 7 for lifting the front end of the paper-pressing plate 15 upward. The lever 16 is pivotably supported at a position below the front end of the paper-pressing plate 15 so that the front end of the lever 16 can move up and down.

By pivoting the lever 16, the lever 16 lifts the front end of the paper-pressing plate 15, shifting the paper-pressing plate 15 into the feeding position. When the paper-pressing plate 15 is in the feeding position, the topmost sheet of paper 3 stacked on the paper-pressing plate 15 is pressed against the feeding roller 10. When the feeding roller 10 rotates, the paper 3 is fed toward a position between the separating roller 8 and separating pad 9.

When the paper tray 7 is removed from the main casing 2, the paper-pressing plate 15 settles into the resting position. While the paper-pressing plate 15 is in the resting position, sheets of the paper 3 can be stacked on the paper-pressing plate 15. After the feeding roller 10 has fed the paper 3 to a position between the separating roller 8 and separating pad 9, the rotating separating roller 8 separates and conveys the paper 3 one sheet at a time. The sheet conveyed by the separating roller 8 passes between the paper dust roller 12 and pinch roller 13, at which time the paper dust roller 12 removes paper dust from the paper 3, and continues along the feeding-end paper-conveying path 11 toward the registration rollers 14.

After registering the paper 3, the registration rollers 14 convey the paper 3 to the conveying belt 53.

(2) Image-Forming Unit (2-1) Scanning Unit

The image-forming unit 5 includes a scanning unit 17, a process unit 18, a transfer unit 19, and a fixing unit 20. A single scanning unit 17 is disposed in the top section of the main casing 2. Although not shown in the drawings, the scanning unit 17 includes a laser light-emitting unit, a polygon mirror, and a plurality of lenses and reflecting mirrors. The laser light-emitting unit emits laser beams based on image data for each color. After passing through the lenses and reflecting off the reflecting mirrors, the laser beams irradiate respective photosensitive drums 24 corresponding to each color.

(2-2) Process Unit

The process unit 18 is disposed below the scanning unit 17 and above the feeding unit 4. As will be described later, the process unit 18 includes a single drum unit 21, and four developer cartridges 22 corresponding to the four colors.

(2-2-1) Drum Unit

As will be described in detail later, the drum unit 21 is detachably mounted in a drum accommodating portion 123 of the main casing 2 from the front side of the main casing 2 in a front-to-rear direction. Note that the front-to-rear direction is a horizontal direction and that the front-to-rear direction is the same as a mounting direction. The front side corresponds to the upstream side in the mounting direction and the rear side corresponds to the downstream side in the mounting direction. The drum unit 21 includes four drum subunits 23 for each of the four colors. Specifically, the four drum subunits 23 are a yellow drum subunit 23Y, a magenta drum subunit 23M, a cyan drum subunit 23C, and a black drum subunit 23K.

The drum subunits 23 are disposed parallel to each other at intervals in the front-to-rear direction. Specifically, the drum subunits 23 are arranged from the front side to the rear side in the order yellow drum subunit 23Y, magenta drum subunit 23M, cyan drum subunit 23C, and black drum subunit 23K. As will be described later, each drum subunit 23 includes a pair of side frame sections 81, and a center frame section 82 spanning between the side frame sections 81 (see FIG. 5).

Figure 2:
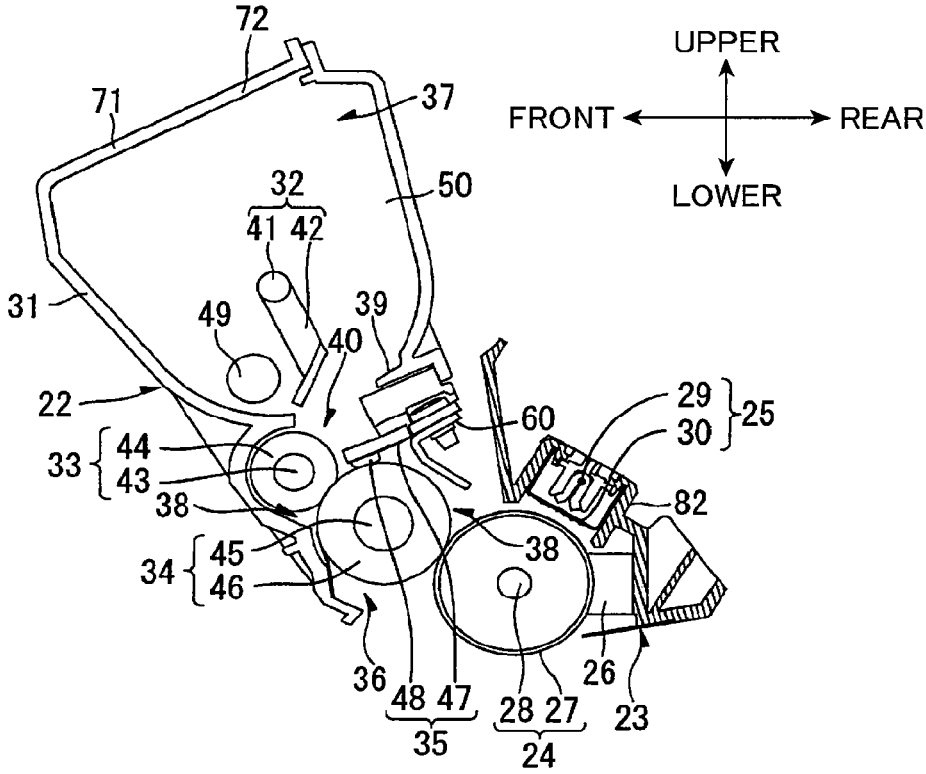
FIG. 2 is a side cross-sectional view of the relevant parts of a drum subunit, on which a developer cartridge is mounted, of the color laser printer shown in FIG. 1.

As shown in FIG. 2, each drum subunit 23 holds the photosensitive drum 24, a Scorotron charger 25, and a cleaning brush 26.

The photosensitive drum 24 extends in a width direction (hereinafter, the width direction will denote a left-to-right direction orthogonal to the front-to-rear direction and the vertical direction). The photosensitive drum 24 includes a main drum body 27 that is cylindrical in shape and has a positive charging photosensitive layer formed of polycarbonate or the like on its outer surface, and a drum shaft 28 disposed along the axis of the main drum body 27 (in the left-to-right direction).

Both widthwise ends of the drum shaft 28 are inserted into the side frame sections 81 described later (see FIG. 5) and are positioned by side plates 101 described later (see FIG. 5).

Rotational support members (not shown) are fitted onto both axial ends of the main drum bodies 27 so as to be incapable of rotating relative to the same but capable of rotating relative to the drum shafts 28. With this structure, the main drum bodies 27 are rotatably supported on the drum shafts 28. During an image-forming process, the photosensitive drum 24 is rotated by a driving force transmitted from a motor (not shown) provided in the main casing 2.

The charger 25 is supported on the center frame section 82 described later diagonally above and rearward of the photosensitive drum 24. The charger 25 opposes the photosensitive drum 24 at a distance. The charger 25 includes a discharge wire 29 disposed in opposition to but separated from the photosensitive drum 24, and a grid 30 provided between the discharge wire 29 and photosensitive drum 24.

The discharge wire 29 is connected to a wire electrode 85 described later (see FIG. 6). The grid 30 is connected to a grid electrode 86 described later (see FIG. 6).

During an image-forming operation, a high-voltage circuit board (not shown) provided in the main casing 2 applies a high voltage to the discharge wire 29 via the wire electrode 85 to produce a corona discharge from the discharge wire 29. At the same time, a high-voltage circuit board (not shown) provided in the main casing 2 applies a high voltage to the grid via the grid electrode 86 to apply a uniform positive charge to the surface of the photosensitive drum 24 while controlling the amount of charge supplied thereto.

The cleaning brush 26 is supported on the center frame section 82 described later at a position rearward of the photosensitive drum 24 and opposes and is in contact with the photosensitive drum 24. During an image-forming operation, a high-voltage circuit board (not shown) provided in the main casing 2 applies a cleaning bias to the cleaning brush 26 via a cleaning electrode 88 described later (see FIG. 6).

(2-2-2) Developer Cartridge

As shown in FIG. 1, the developer cartridges 22 are detachably mounted in correspondence to the drum subunits 23 for each color. Specifically, the developer cartridges 22 include a yellow developer cartridge 22Y detachably mounted on the yellow drum subunit 23Y, a magenta developer cartridge 22M detachably mounted on the magenta drum subunit 23M, a cyan developer cartridge 22C detachably mounted on the cyan drum subunit 23C, and a black developer cartridge 22K detachably mounted on the black drum subunit 23K.

Figure 3:
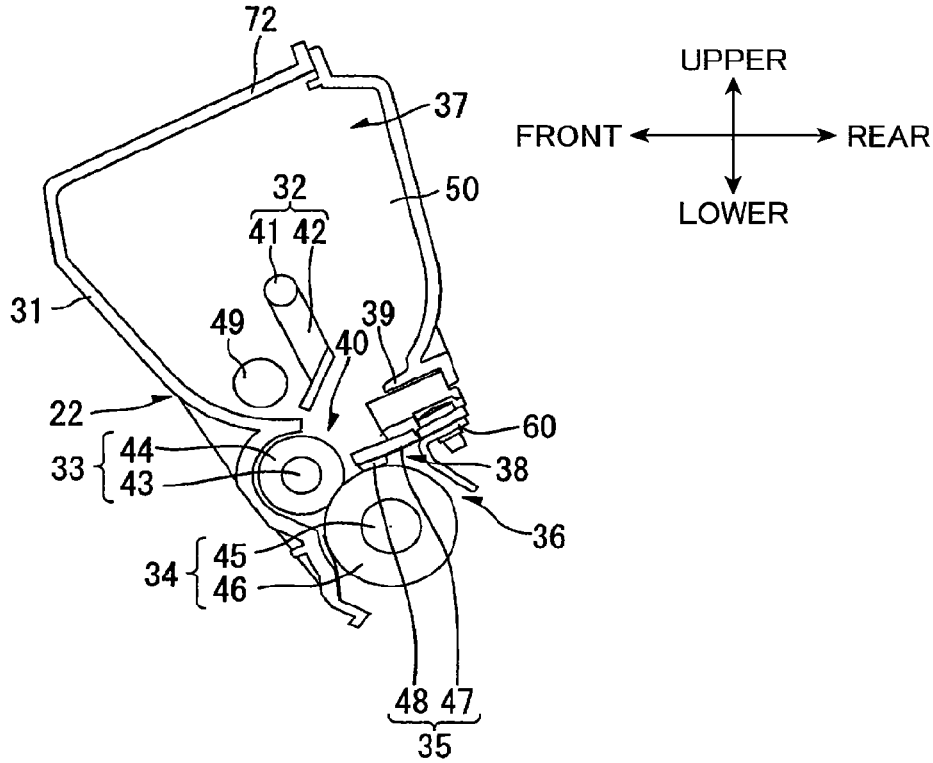
FIG. 3 is a side cross-sectional view of the relevant parts of the developer cartridge shown in FIG. 2.

As shown in FIG. 3, each developer cartridge 22 includes a developer frame 31 and, within the developer frame 31, an agitator 32, a supply roller 33, a developing roller 34, and a thickness-regulating blade 35.

The developer frame 31 is formed in a box shape having an opening 36 on the lower end. A partitioning wall 39 is provided midway in the developer frame 31 with respect to the vertical for partitioning the interior of the developer frame 31 into a toner-accommodating chamber 37 and a developing chamber 38. A through-hole 40 is formed in the partitioning wall 39 to allow communication between the toner-accommodating chamber 37 and developing chamber 38.

Figure 7:
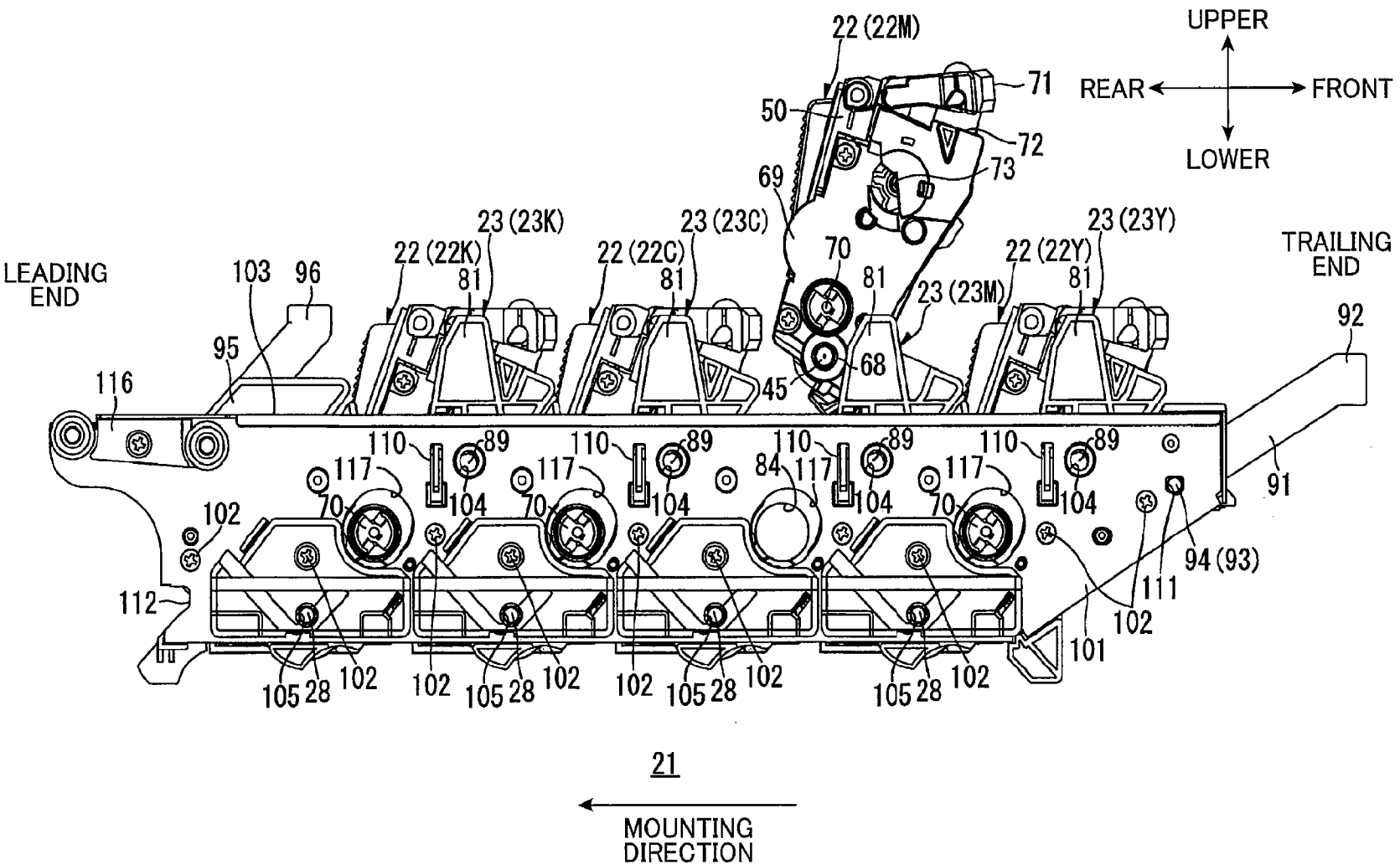
FIG. 7 is a left side view of the drum unit shown in FIG. 4, in which a magenta developer cartridge is not mounted.

In the developer frame 31, as shown in FIG. 7, a gear mechanism (not shown) covered by a gear cover 69 is provided on a left side wall 50. This gear mechanism includes a passive coupling gear 70 being exposed from the gear cover 69 and a gear train (not shown) meshing with the passive coupling gear 70.

To the passive coupling gear 70, a coupling input shaft (not shown) provided inside the main casing 2 is linked in a manner that the coupling input shaft can move forwards and backwards (in the axial direction) and cannot rotate relative to the passive coupling gear 70. To the coupling input shaft, a driving force from a motor (not shown) provided inside the main casing 2 is transmitted.

The gear train (not shown) is constituted by an agitator driving gear meshing with a rotational shaft 41 of the agitator 32, a supply roller driving gear meshing with a supply roller shaft 43 of the supply roller 33, a developing roller driving gear meshing with a developing roller shaft 45 of the developing roller 34 and the like, and these gears mesh with the passive coupling gear 70 through an intermediate gear and the like.

On the left side wall 50, there is provided a new-part detection gear 73 to distinguish a new developer cartridge 22 from an old cartridge. The gear train (not shown) is linked to the new-part detection gear 73.

On the developer frame 31, there is provided a developer cartridge grip 71. The developer cartridge grip 71 is pivotally provided on an upper wall 72 (refer to FIG. 4) of the developer frame 31.

As shown in FIG. 3, the toner-accommodating chamber 37 accommodates toner corresponding to one of the four colors. More specifically, the toner-accommodating chamber 37 of the yellow developer cartridge 22Y accommodates yellow toner, the toner-accommodating chamber 37 of the magenta developer cartridge 22M magenta toner, the toner-accommodating chamber 37 of the cyan developer cartridge 22C cyan toner, and the toner-accommodating chamber 37 of the black developer cartridge 22K black toner.

Windows 49 are also formed in the toner-accommodating chamber 37 for detecting the amount of toner remaining in the toner-accommodating chamber 37. The windows 49 are embedded in both side walls 50 of the developer frame 31 at positions opposing each other across the toner-accommodating chamber 37 (see FIG. 5).

The agitator 32 is disposed in the toner-accommodating chamber 37 and includes a rotational shaft 41 rotatably supported in both side walls 50 of the developer frame 31, and an agitating member 42 provided on the rotational shaft 41 along the axial direction thereof and extending radially outward from the rotational shaft. During image formation, a driving force from a motor (not shown) provided in the main casing 2 is transmitted to the rotational shaft 41 via the passive coupling gear 70, causing the agitating member 42 to move circularly within the toner-accommodating chamber 37.

The supply roller 33 is disposed inside the developing chamber 38 below the through-hole 40. The supply roller 33 includes a supply roller shaft 43 formed of metal that is rotatably supported in both side walls 50 of the developer frame 31, and a sponge roller 44 formed of an electrically conductive sponge material covering the periphery of the supply roller shaft 43. During image formation, a driving force from a motor (not shown) provided in the main casing 2 is transmitted to the supply roller shaft 43 via the passive coupling gear 70 to drive the supply roller 33 to rotate.

The developing roller 34 is disposed inside the developing chamber 38 diagonally below and rearward of the supply roller 33. The developing roller 34 includes a developing roller shaft 45 formed of metal and rotatably supported in both side walls 50 of the developer frame 31, and a rubber roller 46 formed of an electrically conductive rubber that covers the periphery of the developing roller shaft 45.

A developing roller shaft 45 is provided such that both ends in the axial direction protrude toward both sides in the width direction from both sidewalls 50 of the developer frame 31. Conductive collar members 68 (refer to FIG. 7) cover the both ends in the axial direction of the developing roller shaft 45. A developing roller electrode 87 (refer to FIG. 6) to be explained later is connected to the collar member 68 on the right side.

The developing roller 34 is arranged such that the rubber roller 46 and the sponge roller 44 are pressed against each other. Moreover, the developing roller 34 is arranged so as to be exposed downward from an opening 36 of the developing chamber 38.

During image formation, a driving force from a motor (not shown) provided in the main casing 2 is transmitted to the developing roller shaft 45 via the passive coupling gear 70 for rotating the developing roller 34. A developing bias supplied from a high-voltage circuit board (not shown) provided in the main casing 2 is also applied to the developing roller 34 via the developing roller electrode 87.

The thickness-regulating blade 35 is disposed in the developing chamber 38 so as to press against the developing roller 34 from above. The thickness-regulating blade 35 includes a blade 47 configured of a metal leaf spring member, and a pressing part 48 provided on a distal end of the blade 47. The pressing part 48 is formed of an insulating silicon rubber and has a semicircular cross-section.

A base end of the blade 47 is fixed to the partitioning wall 39 by a fixing member 60, while the elastic force of the blade 47 causes the pressing part 48 on the distal end to contact the rubber roller 46 of the developing roller 34 from above.

(2-2-3) Developing Operation in the Process Unit

In each developer cartridge 22, toner of the corresponding color accommodated in the toner-accommodating chamber 37 shifts toward the through-hole 40 by its own weight. As the agitator 32 agitates the toner, some of the toner is discharged through the through-hole 40 into the developing chamber 38.

Toner discharged through the through-hole 40 into the developing chamber 38 is supplied onto the supply roller 33. As the supply roller 33 rotates, the toner carried on the supply roller 33 is supplied to the developing roller 34. At this time, the toner is positively tribocharged between the supply roller 33 and the developing roller 34 as a developing bias is applied to the developing roller 34.

As the developing roller 34 rotates, toner supplied to the surface of the developing roller 34 passes between the pressing part 48 of the thickness-regulating blade 35 and the rubber roller 46 of the developing roller 34, thereby maintaining a thin layer of uniform thickness on the surface of the rubber roller 46.

In the meantime, as shown in FIG. 2, the charger 25 in the drum subunit 23 corresponding to the developer cartridge 22 generates a corona discharge for charging the surface of the photosensitive drum 24 with a uniform positive polarity. As the photosensitive drum 24 continues to rotate, a laser beam emitted from the scanning unit 17 is scanned at a high speed over the positively charged surface of the photosensitive drum 24, forming an electrostatic latent image on the photosensitive drum 24 corresponding to an image that will be formed on the paper 3.

Next, positively charged toner carried on the surface of the developing roller 34 comes into contact with the photosensitive drum 24 as the developing roller 34 rotates and is supplied to areas on the surface of the positively charged photosensitive drum 24 that were exposed to the laser beam and, therefore, have a lower potential. In this way, the latent image on the photosensitive drum 24 is developed into a visible image according to a reverse development process so that the photosensitive drum 24 carries a toner image corresponding to the relevant color.

Toner remaining on the photosensitive drum 24 after the transfer operation is recovered by the developing roller 34. Further, paper dust deposited on the photosensitive drum 24 from the paper 3 is removed by the cleaning brush 26.

(2-3) Transfer Unit

As shown in FIG. 1, the transfer unit 19 is disposed in the main casing 2 above the feeding unit 4 and extends in the front-to-rear direction beneath the process unit 18. The transfer unit 19 includes a drive roller 51, a follow roller 52, the conveying belt 53, transfer rollers 54, and a cleaning unit 55.

The drive roller 51 and follow roller 52 are disposed in opposition to each other across a distance in the front-to-rear direction. The drive roller 51 is disposed rearward of the black drum subunit 23K, while the follow roller 52 is disposed forward of the yellow drum subunit 23Y.

The conveying belt 53 is an endless belt formed of a synthetic resin film such as an electrically conductive polycarbonate or polyimide containing dispersed conductive particles such as carbon. The conveying belt 53 is looped around the drive roller 51 and follow roller 52.

During image formation, a driving force from a motor (not shown) provided in the main casing 2 is transferred to the drive roller 51 for rotating the same. When the drive roller 51 is driven to rotate, the conveying belt 53 travels in a circuit around the drive roller 51 and follow roller 52, while the follow roller 52 follows the movement of the conveying belt 53. The conveying belt 53 moves in the same direction as the surfaces of the photosensitive drums 24 at transfer positions in which the conveying belt 53 contacts the photosensitive drums 24 of the drum subunits 23.

The transfer rollers 54 are disposed inside the conveying belt 53 at positions opposing each photosensitive drum 24 with the conveying belt 53 interposed therebetween. The transfer rollers 54 are configured of a metal roller shaft covered with a rubber roller that is formed of an electrically conductive rubber. The transfer rollers 54 are rotatably provided so that the surfaces of the transfer rollers 54 move in the same direction as the conveying belt 53 at the transfer positions. During image formation, a high-voltage circuit board (not shown) provided in the main casing 2 applies a transfer bias to the transfer rollers 54.

The cleaning unit 55 is disposed below the conveying belt 53 and includes a primary cleaning roller 56, a secondary cleaning roller 57, a scraping blade 58, and a toner collector 59.

The conveying belt 53 moving circuitously along the driving of the drive roller 51 and the following of the follow roller 52 conveys the paper 3 supplied from the feeding unit 4 toward the rear of the printer 1 so that the paper 3 sequentially passes transfer positions corresponding to each drum subunit 23. As the paper 3 is conveyed, toner images in each color carried on the photosensitive drums 24 of each drum subunit 23 are sequentially transferred onto the paper 3, forming a color image thereon.

For example, first the yellow toner image carried on the surface of the photosensitive drum 24 in the yellow drum subunit 23Y is transferred onto the paper 3 after which the magenta toner image carried on the surface of the photosensitive drum 24 in the magenta drum subunit 23M is transferred onto the paper 3 and superimposed over the yellow toner image already transferred. In the same way, the cyan toner image and black toner image carried on the surfaces of the photosensitive drums 24 in the cyan drum subunit 23C and black drum subunit 23K, respectively, are superimposed over the previously transferred toner images to form a color image on the paper 3.

Any toner deposited on the surface of the conveying belt 53 in the transfer operation described above is subsequently cleaned by the cleaning unit 55. First, the toner on the surface of the conveying belt 53 is transferred to the primary cleaning roller 56 by a primary cleaning bias and is subsequently transferred to the secondary cleaning roller 57 by a secondary cleaning bias. Next, the scraping blade 58 scrapes off toner that has been transferred onto the secondary cleaning roller 57. Toner scraped off the secondary cleaning roller 57 drops into the toner collector 59.

(2-4) Fixing Unit

The fixing unit 20 is disposed in the main casing 2, rearward of the black drum subunit 23K and opposite the transfer position in which the photosensitive drum 24 contacts the conveying belt 53 in the front-to-rear direction. The fixing unit 20 includes a heating roller 61 and a pressure roller 62.

After a color image has been transferred onto a sheet of paper 3, the paper 3 is conveyed to the fixing unit 20. In the fixing unit 20, the color image is fixed to the paper 3 by heat as the paper 3 passes between the heating roller 61 and pressure roller 62.

(3) Discharge Unit

A discharge-end conveying path 63 is provided in the discharge unit 6. The discharge-end conveying path 63 is substantially U-shaped in a side view, with an upstream end positioned on the lower side adjacent to the fixing unit 20 and a downstream end positioned on the upper side adjacent to a discharge tray 64 formed on top of the main casing 2. Hence, the discharge-end conveying path 63 initially guides the paper 3 rearward, then reverses directions and discharges the paper 3 in a forward direction.

A transfer roller 65 and a pinch roller 66 are disposed in confrontation with each other along the discharge-end conveying path 63. Further, a pair of discharge rollers 67 is disposed on the downstream end of the discharge-end conveying path 63. The discharge tray 64 is formed on top of the main casing 2 as a depression that grows gradually deeper toward the rear side. The discharge tray 64 functions to support sheets of discharged paper 3 in a stacked state.

After the paper 3 passes through the fixing unit 20, the transfer roller 65 and pinch roller 66 convey the paper 3 along the discharge-end conveying path 63 toward the discharge rollers 67 and the discharge rollers 67 discharge the paper 3 onto the discharge tray 64.

2. Drum Unit

Next, the drum unit 21 will be described with reference to FIGS. 4 through 12.

Figure 4:
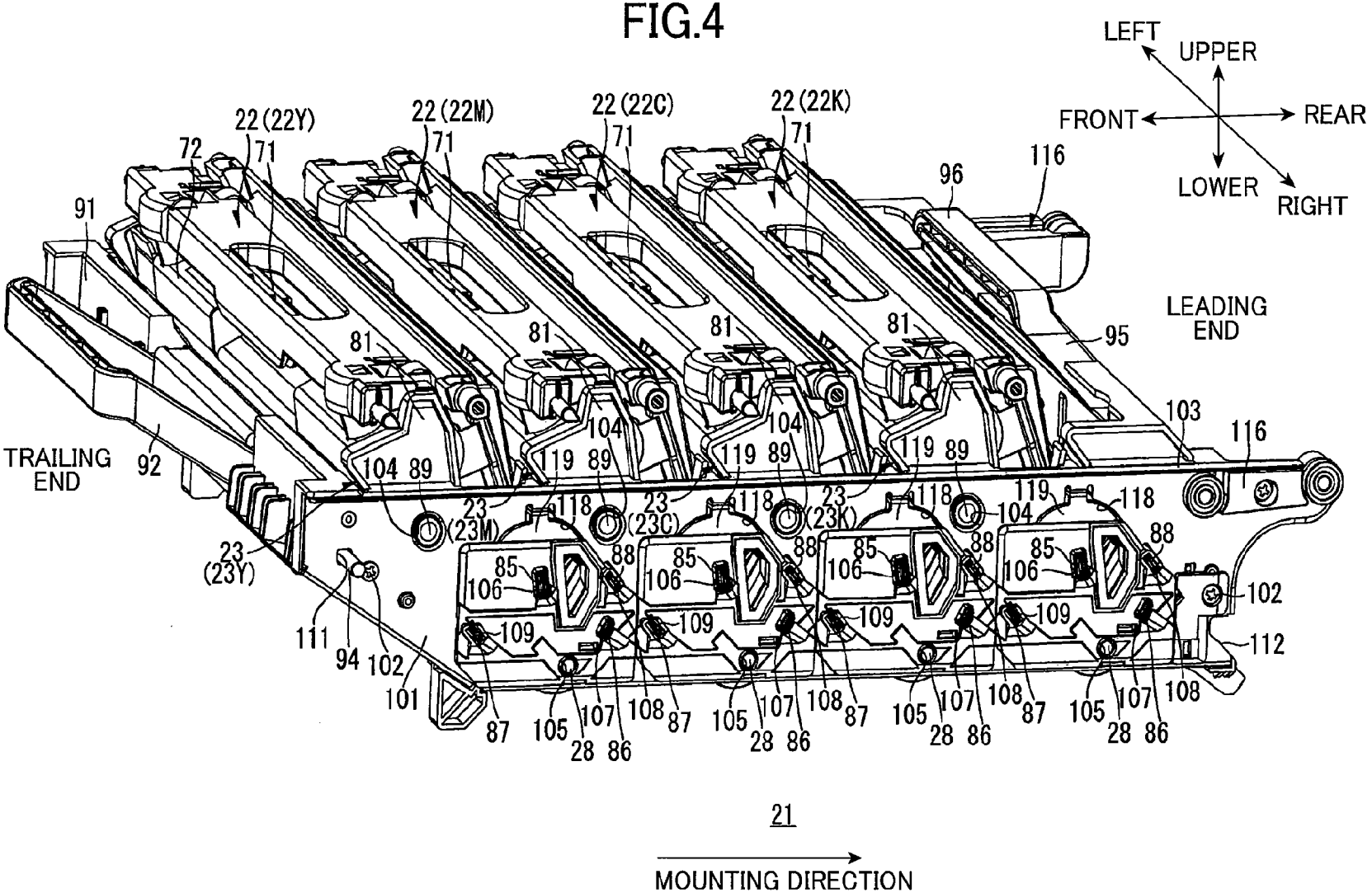
FIG. 4 is a perspective of the drum unit in which developer cartridges are mounted, as viewed from the upper-right.

As shown in FIG. 4, the drum unit 21 includes the four drum subunits 23 corresponding to the four colors and juxtaposed in the front-to-rear direction; a front beam 91 and a rear beam 95 disposed on front and rear sides of the four drum subunits 23; and the pair of side plates 101 disposed on widthwise ends of the front beam 91, the four drum subunits 23, and the rear beam 95.

The four drum subunits 23, the front beam 91, the rear beam 95, and the pair of side plates 101 constituting the drum unit 21 can be slidably mounted into or removed from the drum accommodating portion 123 (see FIG. 8) of the main casing 2 as an integrated unit.

(1) Drum Subunits

Figure 5:
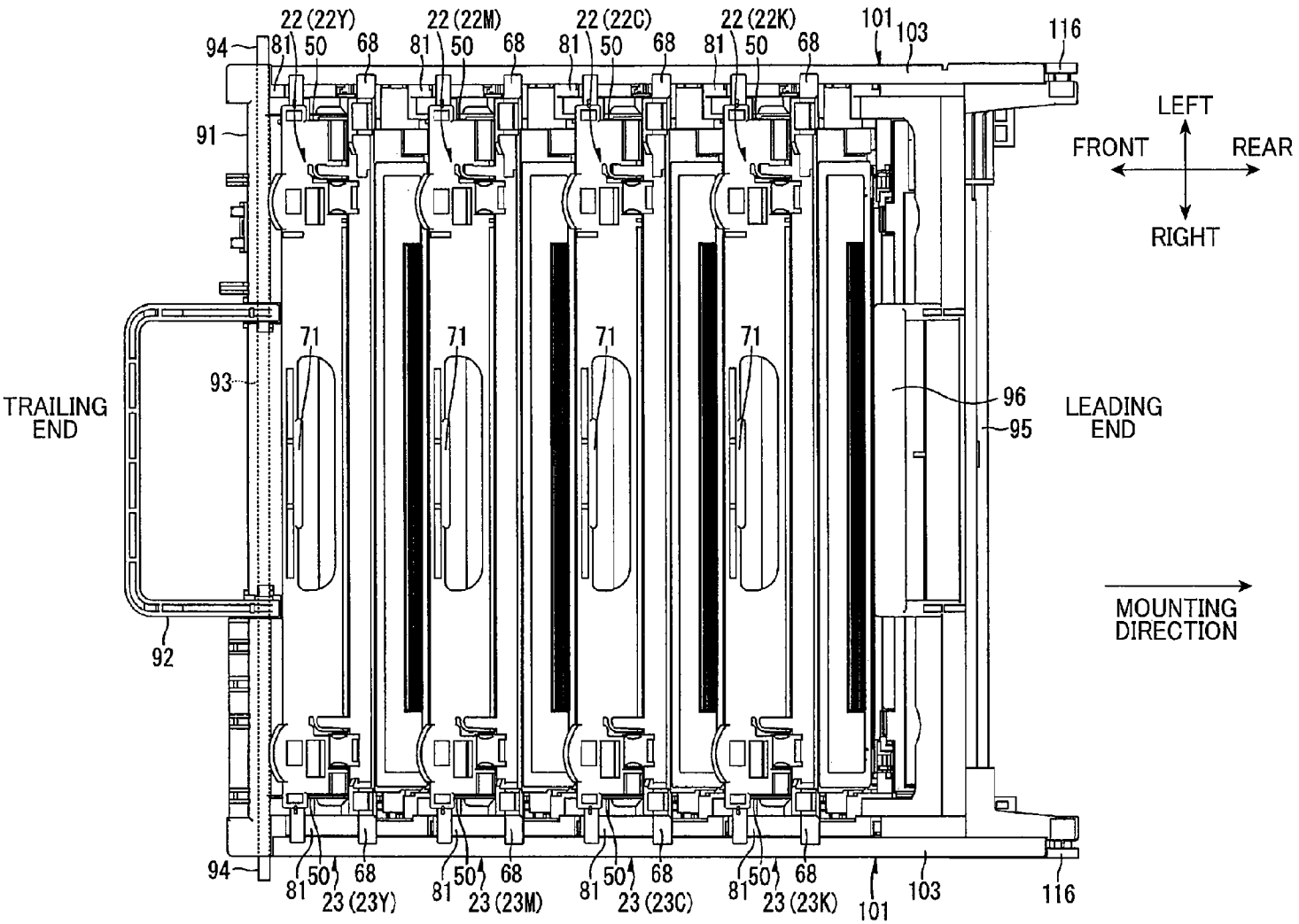
FIG. 5 is a plan view of the drum unit shown in FIG. 4.

As shown in FIG. 5, the drum subunit 23 made from a resin material includes the pair of side frame sections 81 disposed in opposition to each other over a distance in the width direction, and the center frame section 82 (see FIG. 2) that spans between the side frame sections 81.

Figure 6:
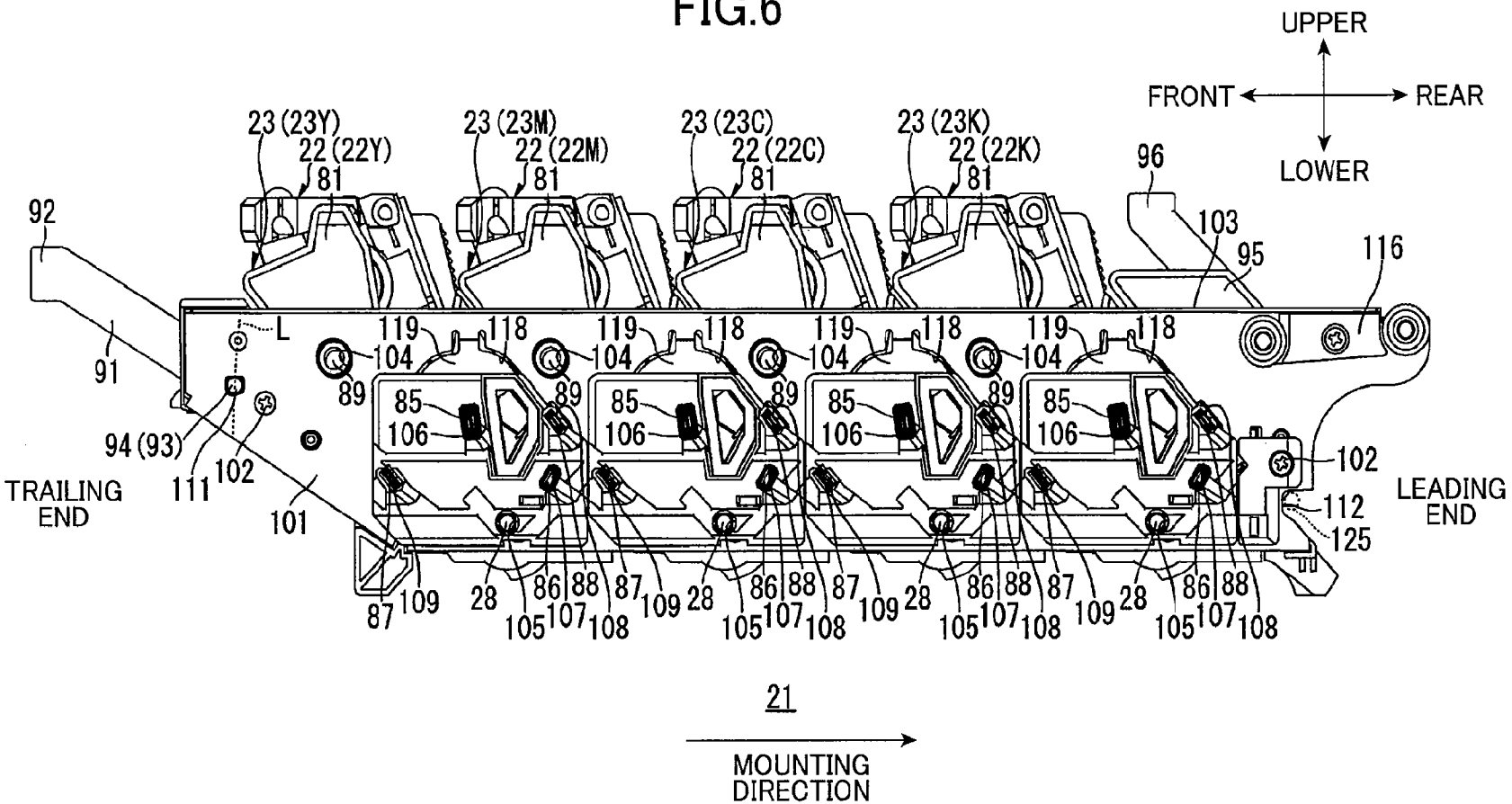
FIG. 6 is a right side view of the drum unit shown in FIG. 4.

As shown in FIGS. 6 and 7, each side frame section 81 is formed in a plate shape. Guide grooves (not shown) are formed in the inner wall surfaces of the side frame sections 81 at positions opposing each other in the width direction for guiding the developer cartridge 22 as the developer cartridge 22 is mounted in or removed from the drum subunit 23.

Note that each guide groove is formed from a front side upper edge of the side frame section 81 to the vicinity of the rear side lower end of the side frame section 81 along the substantially vertical direction. A downstream end (the deepest part) of the guide groove is located at a position of the developing roller shaft 45 when the developer cartridge 22 is mounted on the drum subunit 23 and the developing roller 34 is in contact with a photosensitive drum 24. The collar members 68 covering the developing roller 45 are slidably received in the guide grooves.

Bosses 89 are formed in the upper side of the side frame sections 81. The bosses 89 are cylindrical in shape and protrude outward in the width direction from the outer wall of the side frame sections 81. When the developer cartridge 22 is mounted on the drum subunit 23, the windows 49 (FIG. 2) of the developer cartridge 22 oppose each other in the width direction through the bosses 89.

The drum shaft 28 of the photosensitive drum 24 extends through each side frame section 81, as described above.

As shown in FIG. 7, a coupling inner through-hole 84 is formed in the side frame section 81 on the left side at a position corresponding to the passive coupling gear 70 of the developer cartridge 22 in the width direction when the developer cartridge 22 is mounted on the drum subunit 23. The coupling inner through-hole 84 is a circular hole penetrating the left side frame section 81 in the width direction.

As shown in FIG. 6, the wire electrodes 85, grid electrodes 86, developing roller electrodes 87, and cleaning electrodes 88 are supported in the right side frame section 81 by being inserted through the side frame section 81 in the thickness direction so as to protrude outward in the width direction from the outer wall surface of the side frame section 81.

The wire electrode 85 is arranged substantially in the center of the front-to-rear direction and the vertical direction of the side frame section 81. The grid electrode 86 is placed midway in the vertical direction of the rear end of the side frame section 81. The developing roller electrode 87 is arranged midway in the vertical direction of the front end of the side frame section 81. The cleaning electrode 88 is arranged midway in the vertical direction of the rear end of the side frame section 81 and is disposed above the grid electrode 86.

As shown in FIG. 2, the center frame section 82 is mounted between a pair of the side frames 81 opposing each other in the width direction, holding the charger 25 and the cleaning brush 26.

As shown in FIG. 7, the developer cartridge 22 is mounted on each drum subunit 23 corresponding to each color. Each of the collar members 68 at both ends in the axial direction of the developing roller shaft 45 is inserted into the guide groove (not shown) formed at each side frame section 81 of each corresponding drum subunit 23. The collar member 68 is slid downward along the guide groove, abutting the deepest part of the guide groove. In this way, each developer cartridge 22 is mounted on a corresponding drum subunit 23.

As shown in FIG. 6, in the mounted state of the developer cartridge 22 to the drum subunit 23, the collar member 68 at the right side is connected to the developing roller electrode 87 provided on the side frame section 81 at the right side. As shown in FIG. 7, the passive coupling gear 70 opposes the coupling inner through-hole 84 in the width direction, allowing the coupling input shaft (not shown) to pass therethrough forward and backward (in the axial direction).

(2) Front Beam

As shown in FIG. 4, a front beam 91 is integrally formed of a resin material and, as shown in FIG. 5, placed on the front side of four drum subunits 23 which are arranged in parallel in the front-to-rear direction and mounted between the pair of side plates 101.

As shown in FIGS. 5 and 6, the front beam 91 is formed, in side view, obliquely from the lower-rear side to the upper-front side. The front beam 91 includes a near side grip 92 provided at the center in the width direction and a support axis member 93 pivotally supporting the near side grip 92.

The support axis member 93 is made of an integrally formed shaft member and is arranged so as to extend through the front beam 91 along the width direction, while being supported by the front beam 91. Both ends in the width direction of the support axis member 93 protrude from the front beam 91 outwardly in the width direction, and a part protruding from the front beam 91 is defined as a positioning part 94 (pressing-force receiving member).

The near side grip 92 is substantially U-shaped in plan view, and each end is pivotally supported by the support axis member 93. The near side grip 92 pivotally moves, with the support axis member 93 as a fulcrum, between a down position (refer to FIG. 6) where the grip 92 falls down when a front cover 120 of the main casing 2 swings to an open position, and an upright position (refer to FIG. 1) where the grip 92 stands up when the front cover 120 of the main casing 2 swings to a closed position.

(3) Rear Beam

A rear beam 95 is integrally formed of a resin material, arranged at the rear of four drum subunits 23 which are arranged in parallel in the front-to-rear direction and mounted between the pair of side plates 101.

As shown in FIG. 6 (in side view), the rear beam 95 is substantially L-shaped with the upper end protruding frontward, and, as shown in FIG. 5 (in plan view), substantially U-shaped with the rear being open. On the rear beam 95, there is integrally provided a far side grip 96 at the center in the width direction. The far side grip 96 is U-shaped in rear view, and each end is linked to the rear beam 95. The far side grip 96 is formed obliquely from the lower-rear side to the upper-front side, and is provided so as to protrude obliquely upward from the rear beam 95.

(4) Side Plates

The side plates 101 are installed as a pair, as shown in FIG. 5, so as to sandwich the front beam 91, the four drum subunits 23, and the rear beam 95 from both sides in the width direction.

Each side plate 101 is formed of a material having higher rigidity than the resin material forming the front beam 91, each drum subunit 23, and the rear beam 95, such as a metal or a fiber-reinforced resin, and preferably a steel plate, for example.

Each side plate 101 is made in a substantially long rectangular shape, in side view, which extends in the front-to-rear direction. The front end of the side plate 101 opposes and is fixed to the front beam 91. The rear end of the side plate 101 opposes and is fixed to the rear beam 95.

More specifically, in the mutually adjacent drum subunits 23, the four drum subunits 23 are adjacently arranged in the front-to-rear direction in the state where the subunits 23 are obliquely oriented from the upper-front side toward the lower-rear side, by abutting the front end surface of each side frame section 81 of the rear-side (leading-end side) drum subunit 23 to the rear end surface of each side frame section 81 of the front-side (trailing-end side) drum subunit 23. Further, the rear end surface of the front beam 91 contacts the front end surface of each side frame section 81 of the drum subunits 23 at the farthest front position, while the front end surface of the rear beam 95 contacts the rear end surface of each side frame section 81 of the drum subunits 23 at the rearmost position.

Each side plate 101 is, as shown in FIG. 6 and FIG. 7, secured by a screw 102 to each of the front beam 91, the four drum subunits 23, and the rear beam 95.

At an upper end of each side plate 101, an upper edge thereof is formed in a straight line along the front-to-rear direction (the horizontal direction). More specifically, the upper end of each side plate 101 is bent outwardly in the width direction to form the L shape in cross-section, forming a flange part 103 extending outwardly in the width direction over its length in the front-to-rear direction. The flange part 103 slidably moves on a rail (not shown) which is formed on a metal frame 122 of the main casing 2 to be explained later.

At a lower end of each side plate 101, a lower edge thereof is arranged so as to be in parallel to the upper edge along the front-to-rear direction (the horizontal direction), and on a shorter straight line than the upper edge, not opposing the both ends in the front-to-rear direction of the upper edge but opposing the middle part of the upper edge.

Four light transmission openings 104 are formed at the upper end of each side plate 101 for receiving the boss 89 of each drum subunit 23.

Each light transmission opening 104 is formed at the upper end of the side plate 101 along the front-to-rear direction, four openings being mutually spaced. The light transmission opening 104 is formed as a circular through-hole at a position opposing each window 49 of the developer cartridge 22 and each boss 89 in the width direction. The boss 89 of each drum subunit 23 is fit in each light transmission opening 104 so as to expose each boss 89 to the outside in the width direction. Thus, each drum subunit 23 is prevented from pivotally moving about the drum shaft 28 relative to each side plate 101.

At each side plate 101, there is formed at the lower end thereof an axis hole 105 penetrating through the end in the axial direction of each drum shaft 28. Four axis holes 105 are mutually spaced along the front-to-rear direction at the lower end of the side plate 101. The axis hole 105 is formed as a rectangular through-hole penetrating through the thickness direction at a position opposing the axial end of each drum shaft 28 in the width direction. The both ends of the drum shaft 28 of the photosensitive drum 24 of each drum subunit 23 are inserted in a pair of the axis holes 105 opposing each other in the width direction.

Note that the end of each drum shaft 28 is urged at the axis hole 105 by a wire spring (not shown) so as to provide a point contact on a peripheral surface of the axis hole 105.

By this means, each drum shaft 28 is positioned at each axis hole 105 and mutually spaced so that a direction of straight line passing through a rotational axis of each drum shaft 28 follows the front-to-rear direction (the horizontal direction).

As shown in FIG. 6, four electrode openings 118 are formed in the side plate 101 on the right side, and a sealing member 119 made of an insulating rubber material is embedded at each electrode opening 118. A developing roller opening 109, a wire electrode opening 106, a grid electrode opening 107, and a cleaning electrode 108 are formed on each sealing member 119, so as to expose the developing roller electrode 87, the wire electrode 85, the grid electrode 86, and the cleaning electrode 88 to the outside in the width direction from the right-side side plate 101.

Four electrode openings 118 and four sealing members 119 are formed, mutually spaced along the front-to-rear direction.

At each sealing member 119, there are formed the developing roller opening 109, the wire electrode opening 106, the grid electrode opening 107, and the cleaning electrode 108 so as to penetrate through the thickness direction at the positions opposing the developing roller electrode 87, the wire electrode 85, the grid electrode 86, and the cleaning electrode 88, respectively, in the width direction.

As shown in FIG. 7, a coupling outer through-hole 117 is formed in the left-side side plate 101 to oppose the passive coupling gear 70 of each developer cartridge 22 in the width direction.

Four coupling outer through-holes 117 are formed along the front-to-rear direction, mutually spaced from each other at the center of the side plate 101 in the vertical direction. Each coupling outer through-hole 117 is formed as a circular through-hole penetrating through the thickness direction at a position opposing the coupling inner through-hole 84 of the left side frame section 81 in the width direction.

At the side plate 101 on the left side, there are provided four new-part detection levers 110 on the front side of coupling outer through-holes 117 but on the rear side of light transmission openings 104.

Each new-part detection lever 110 is made of a plate member extending in the vertical direction, swingably provided to a slit formed in the side plate 101 on the left side along the vertical direction. Each new-part detection lever 110 swings or stops in response to a rotation or a stop of a new-part detection gear 73 of each developer cartridge 22, thus determining whether each developer cartridge 22 is new.

The front end (the trailing end in the mounting direction) of each side plate 101 has: the upper edge extending on the straight line; a lower oblique edge extending from the front end of the lower edge toward obliquely front-upward; and a front vertical edge extending in the vertical direction and linking between the front end of the upper edge and the front end of the lower oblique edge. A substantially trapezoidal shape in side view is thus formed with a narrowing width toward front.

At the front end of each side plate 101, there is formed a support axis through-hole 111 through which the support axis member 93 is inserted. To the support axis through-hole 111, the support axis member 93 protruding outwardly in the width direction from the front beam 91 is inserted to protrude outwardly in the width direction. This enables the positioning parts 94 that protrude in the width direction to be respectively disposed at the front end of each side plate 101.

The rear end (the leading end in the mounting direction) of each side plate 101 has: the upper edge extending on the straight line; and a rear edge extending upward from the rear end of the lower edge, then curving and extending rearward, further curving and extending upward to be linked to the rear end of the upper edge. A substantially L-shape in side view is thus formed with the upper edge that protrudes rearward.

At the rear end of each side plate 101, there is formed a notch part 112 which holds a reference axial member 125 from both above and below in the state that the drum unit 21 is mounted on the main casing 2.

Figure 11:
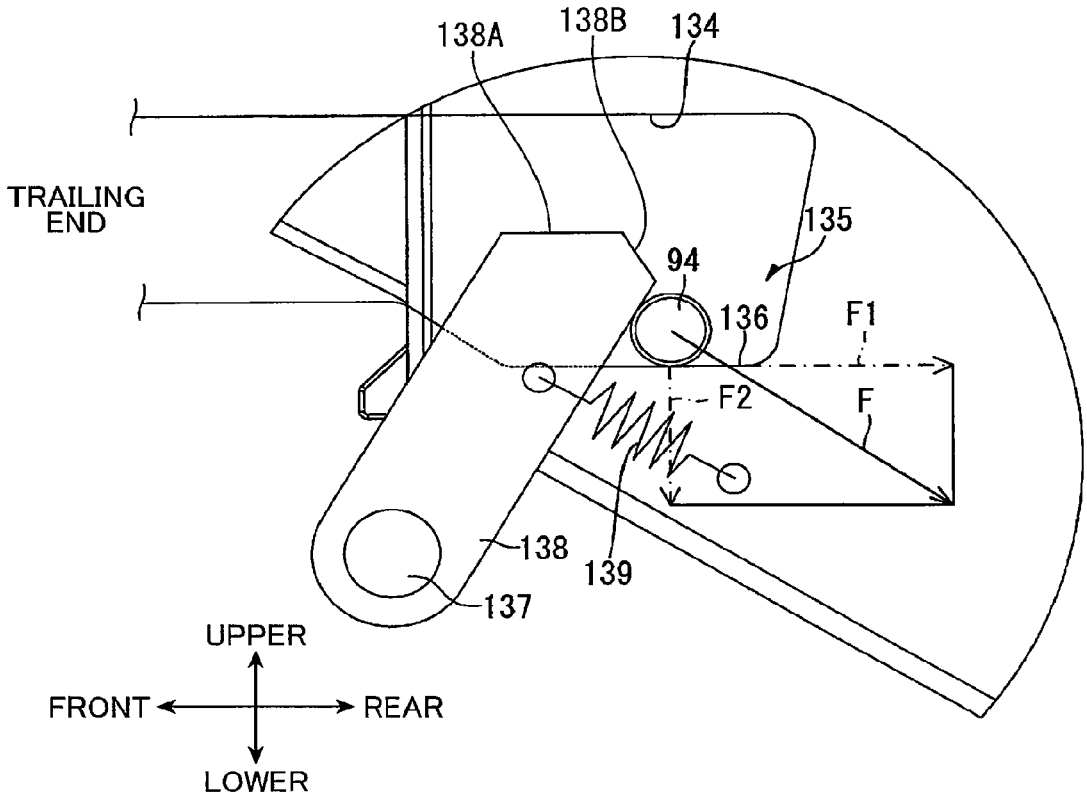
FIG. 11 is an enlarged right side view of the relevant parts of a pressing mechanism shown in FIG. 10.
Figure 12:
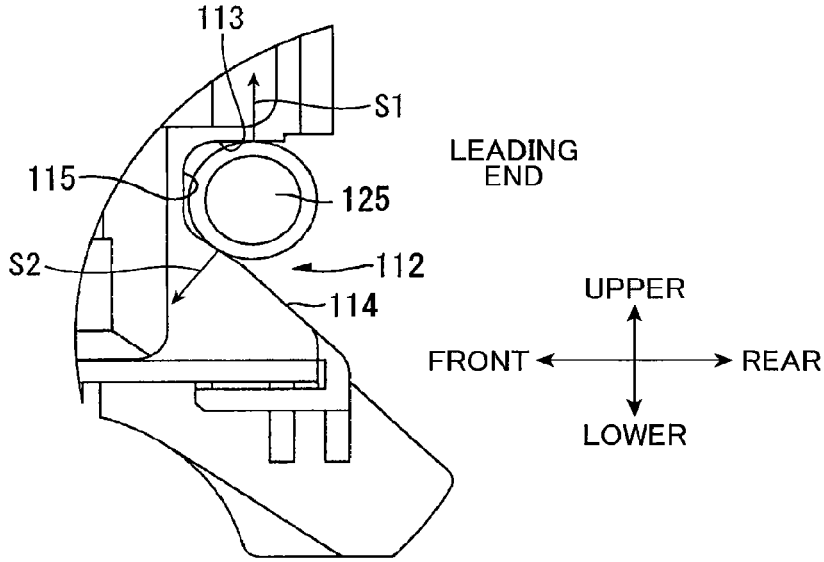
FIG. 12 is an enlarged right side view of the relevant parts of a rear end of the drum unit.

The notch part 112 is formed at the lower part of the rear edge, more specifically, at a position near the rear end of the lower edge. The notch part 112 is formed in a substantially concave shape with the rear open. More specifically, as shown in FIG. 12, the notch part 112 has an upper edge 113, a lower edge 114, and an inner edge 115. The upper edge 113 and the lower edge 114 hold the reference axial member 125 from above and below. The upper edge 113 is formed on a straight line from the rear end to the deepest part (the inner edge 115) along the front-to-rear direction. As shown in FIG. 12, a pressing force in a first positioning direction S1 is applied to the upper edge 113, and another pressing force in a second positioning direction S2 is applied to the lower edge 114 in the state that the drum unit 21 is mounted on the main casing 2. The direction of the force S1 is opposite to a downward direction F2 (FIG. 11). In other words, the upper edge 113 (first contact surface) defines the first positioning direction S1 that is perpendicular to the upper edge 113 and that intersects a predetermined reference direction (the front-to-rear direction and the direction in which the photosensitive drums 24 are arranged). The lower edge 114 (second contact surface) defines the second positioning direction S2 that is perpendicular to the lower edge 114 and that intersects both the predetermined reference direction and the first positioning direction S1. The lower edge 114 is formed on a straight line slanting at a constant gradient from the lower-rear side to the upper-front side from the rear edge to the deepest part (the inner edge 115). The inner edge 115 is formed on a straight line along the vertical direction so as to connect the front end of the upper edge 113 to the front end of the lower edge 114. Note that the connecting portion between the front end of the upper edge 113 and the upper end of the inner edge 115 is formed in a curved shape, and that the connecting portion between the front end of the lower edge 114 and the lower end of the inner edge 115 is formed in a curved shape.

As shown in FIGS. 4 through 7, at the rear end of each side plate 101, on the upper side thereof, there is provided a roller member 116 which rolls relative to a rail (not shown) formed on the metal frame 122 to be explained later of the main casing 2 when the drum unit 21 is mounted on or removed from the main casing 2.

3. Main Casing

As shown in FIG. 1, the front cover 120 is provided on the front wall of the main casing 2. The front cover 120 has a lower end which is swingably supported by a hinge or the like at the front wall of the main casing 2 and provided so that the upper end thereof moves between the closed position of abutting the upper wall of the main casing 2 and the open position which is farthest away from the upper wall of the main casing 2.

When the front cover 120 is swingably moved to the open position, the drum accommodating portion 123 (FIG. 8) to which the drum unit 21 is detachably mounted is exposed from the drum access opening 124.

Figure 8:
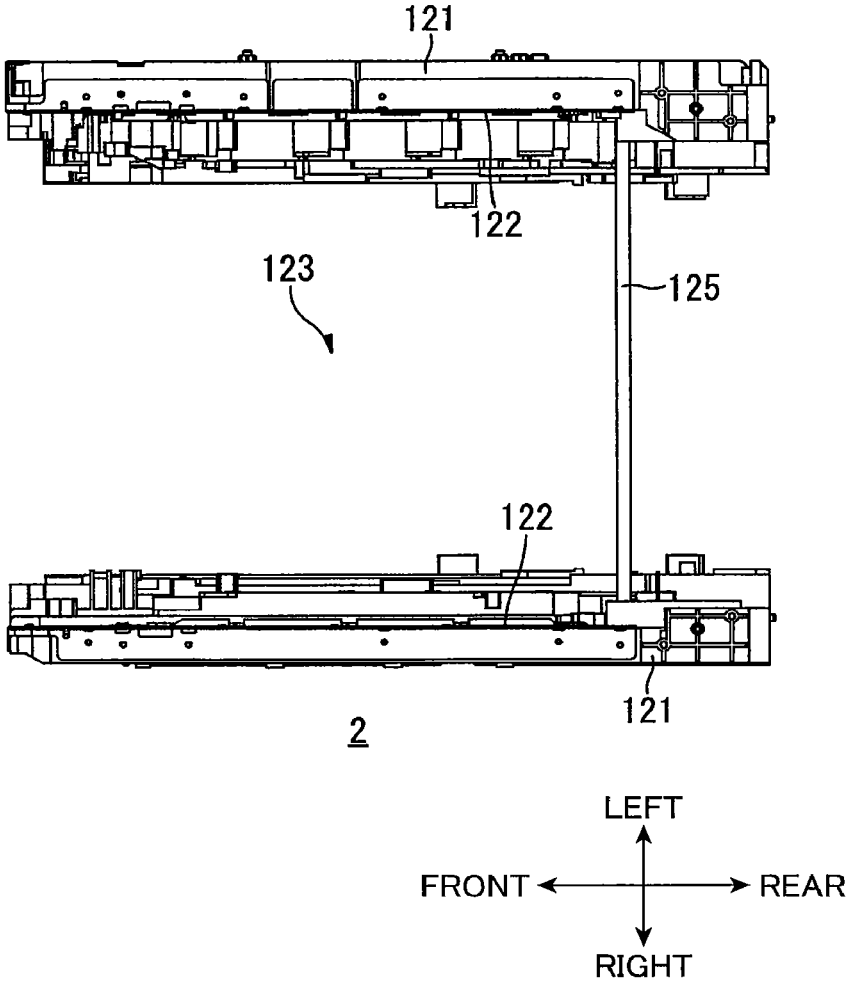
FIG. 8 is a plan view showing a drum accommodating portion of a casing.
Figure 9:
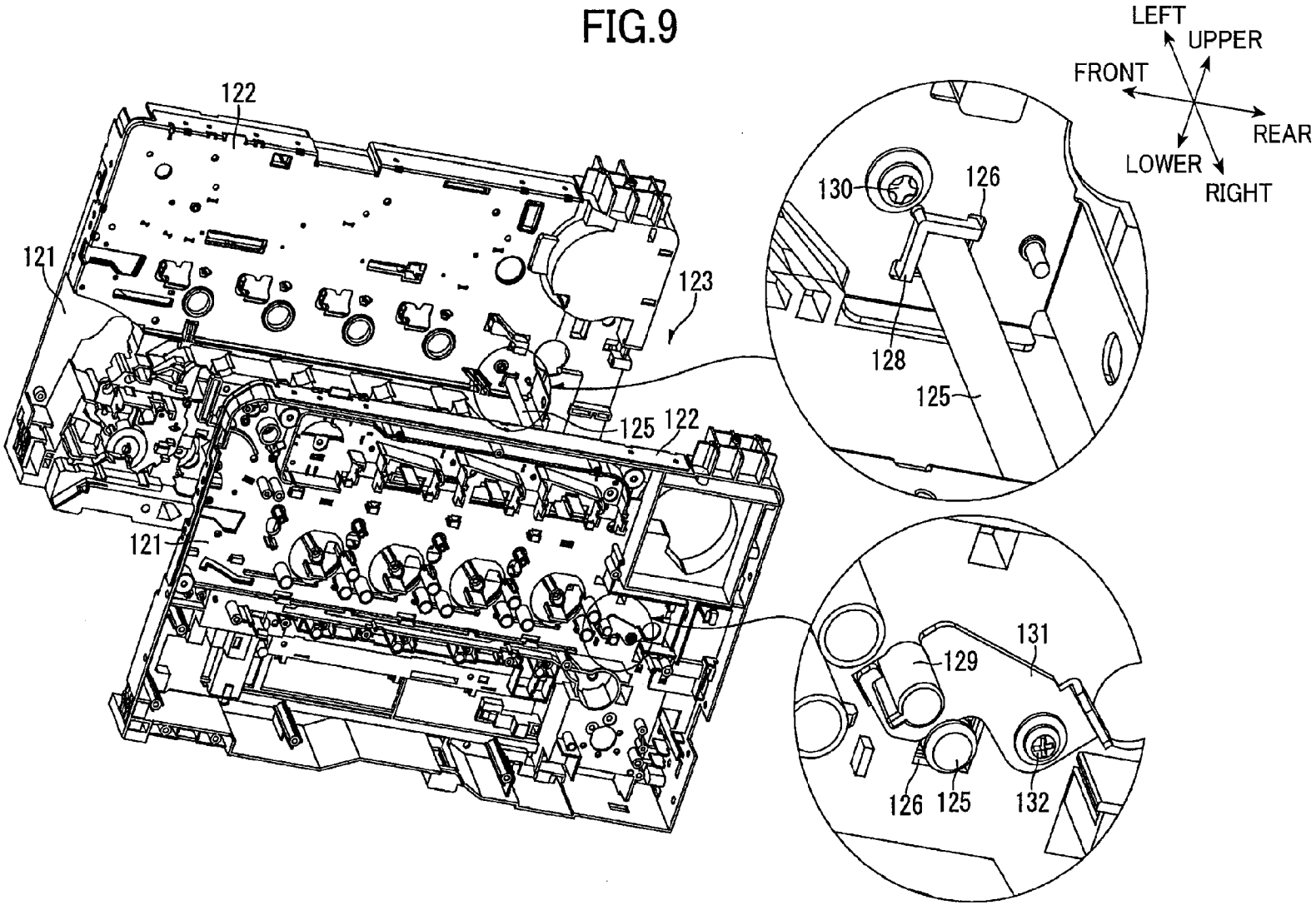
FIG. 9 is a perspective view of the drum accommodating portion shown in FIG. 8, in which the drum unit is not mounted, as viewed from the upper right.

As shown in FIGS. 8 and 9, the main casing 2 has a pair of resin frames 121, which are arranged opposing each other with a space therebetween in the width direction and sandwiching the drum unit 21 while the drum unit 21 is in the mounted state. The metal frames 122 are respectively provided on upper half portions on the inside surface in the width direction of each resin frame 121.

Figure 10:
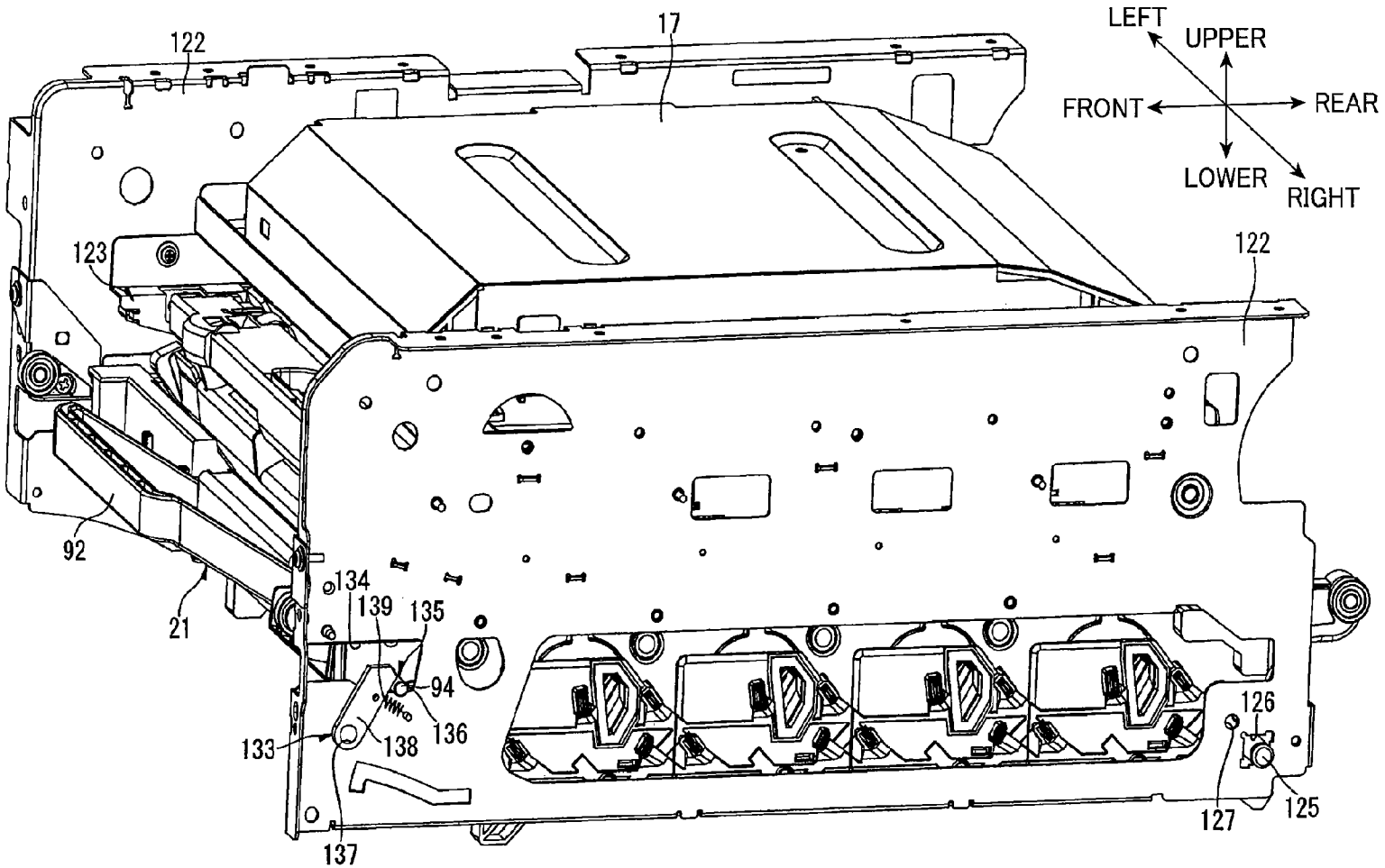
FIG. 10 is a perspective view of the drum accommodating portion shown in FIG. 8, in which the drum unit is mounted, as viewed from the upper right.

As shown in FIG. 10, the scanning unit 17 mentioned above is provided on the upper side between the metal frames 122. The lower side of the scanning unit 17 between the metal frames 122 is defined as the above-mentioned drum accommodating portion 123.

As shown in FIGS. 8 through 10, the reference axial member 125 is provided at the rear end (the leading end in the mounting direction) on the main casing 2 for contacting the notch part 112 of each side plate 101.

The reference axial member 125 extends along the width direction between the metal frames 122 and is fixed to the lower side of the rear end of each metal frame 122.

The both ends in the axial direction of the reference axial member 125 are fixed to each metal frame 122 as follows.

Namely, as shown FIG. 10, at the lower side of the rear end of each metal frame 122, there is formed a reference axial member through-hole 126. Each reference axial member through-hole 126 is an angular through-hole. The both ends in the axial direction of the reference axial member 125 are loosely inserted in each reference axial member through-hole 126.

At the metal frames 122, there are respectively formed screw holes 127, spaced apart, at the obliquely upward on the front side of the reference axial member through-holes 126.

As shown in FIG. 9, an L-shaped member 128 (second fixing part) is inserted in each reference axial member through-hole 126 from the outside toward the inside in the width direction. A screw-fixing tube part 129 (first fixing part) is also integrally formed with each resin frame 121 to oppose each screw hole 127 from the outside in the width direction and to protrude outwardly in the width direction. The screw-fixing tube part 129 is disposed at a predetermined distance from the reference axial member through-hole 126.

Each L-shaped member 128 is arranged between the reference axial member 125 and a peripheral edge of each reference axial member through-hole 126 so as to contact the upper edge and the front edge of each reference axial member through-hole 126.

A screw 130 is inserted in the screw hole 127 of each metal frame 122 from inside thereof in the width direction and is screwed to each screw-fixing tube part 129. In this way, the screw 130 extends through the screw hole 127, while the L-shaped member 128 extends through the reference axial member through-hole 126.

On the outside surface of each resin frame 121 in the width direction, there is installed a cam plate 131 (urging member) to urge the reference axial member 125 and the screw-fixing tube part 129 in a direction away from each other.

Each cam plate 131 is substantially S shaped in side view as arranged along the front-to-rear direction, and the rear end is secured by a fixing screw 132 to the resin frame 121. The front end of the cam plate 131 is disposed between the reference axial member 125 and the screw-fixing tube part 129, contacts the reference axial member 125 obliquely from the upper-front side, contacts obliquely the screw-fixing tube part 129 from the lower-rear side, and urges the reference axial member 125 and the screw-fixing tube part 129 in the direction away from each other.

By this means, the both axial ends of each reference axial member 125 are positioned so as to maintain a point contact with the lower edge and the rear edge of each reference axial member through-hole 126 of each metal frame 122.

As shown in FIGS. 10 and 11, on this casing 2, at the front end (the upstream end in the mounting direction) there is provided a pair of pressing mechanisms 133 to press each positioning part 94 of the drum unit 21.

Each pressing mechanism 133 is provided so as to oppose each other at a distance in the width direction at the front end of each metal frame 122. More specifically, a groove 134 is formed at the front end of each metal frame 122, and each pressing mechanism 133 is provided in the vicinity of each groove 134.

Each groove 134 is formed from the front edge substantially in the center in the vertical direction of each metal frame 122 toward the rear side so as to be notched in a substantially rectangular shape in side view. Further, at the rear end of each groove 134, there is sequentially formed a concave portion 135 which is formed to sink in a substantially concave shape downward. The lower edge of the concave portion 135 is formed on the straight line along the front-to-rear direction (the horizontal direction) to provide a contact surface 136 for contacting the positioning part 94.

Each pressing mechanism 133 includes a swing axis 137, a pressing arm 138, and a spring 139.

The swing axis 137 is positioned below the groove 134 and is provided so as to protrude from the metal frame 122 to the outside in the width direction.

The pressing arm 138 is formed in a substantially long plate shape, one end (the lower end) of which is swingably supported by the swing axis 137, and the other end (the upper end) of which is arranged to oppose the concave portion 135.

As shown in FIG. 11, the upper end of the pressing arm 138 has two linear edges 138A and 138B. The edge 138A extends substantially in the front-to-rear direction (horizontal direction). The edge 138B connects to the rear end of the edge 138A and extends obliquely from the upper-front side toward the lower-rear side. The edges 138A and 138B have the above-described shapes for guiding the positioning part 94 to the contact surface 136 of the groove 135 when the drum unit 21 is mounted into the main casing 2. Alternatively, the edges 138A and 138B may be formed as a curved edge.

Note that some edges of the near side grip 92 and the side plate 101 are shown in FIG. 11 for explanatory purposes. Actually, these edges are not shown since the near side grip 92 and the side plate 101 are located behind the resin frame 121.

The spring 139 is arranged obliquely from the upper-front side to the lower-rear side. One end (the front end) of the spring 139 is linked to the other end (the upper end) of the pressing arm 138, and the other end (the rear end) of the spring 139 is fixed to the metal frame 122.

The pressing arm 138 opposes the concave portion 135 in such a manner that the other end (the upper end) at all times intersects the contact surface 136 in side view due to an urging force of the spring 139, and is urged in the direction that the pressing arm 138 swings obliquely to the lower-rear side. By this means, the pressing arm 138 is arranged obliquely such that one end (the lower end) thereof is arranged at the lower-front side at all times and that the other end (the upper end) thereof is arranged at the upper-rear side.

4. Mounting the Drum Unit on the Casing

When mounting the drum unit 21 on the main casing 2, first, the near side grip 92 and the far side grip 96 of the drum unit 21 are held with both hands, and the drum unit 21 is lifted. At this time, that is, before mounting the drum unit 21 on the main casing 2, since the front beam 91, the four drum subunits 123, and the rear beam 95 which are sandwiched between the pair of side plates 101 are formed of resin materials, flexure and torsion of these parts are relatively permitted. In other words, the drum unit 21 employs a flexible structure before being mounted on the main casing 2.

When the front cover 120 is swung to the open position, the drum accommodating portion 123 is exposed from the drum access opening 124 of the main casing 2. Thus, the drum unit 21 is mounted into the drum accommodating portion 123 along the front-to-rear direction (the horizontal direction) from the front side to the rear side.

When mounting the drum unit 21 into the drum accommodating portion 123, each roller member 116 provided at the rear end of the drum unit 21 is rolled on the rail (not shown) formed on the metal frame 122 on both sides in the width direction of the drum accommodating portion 123, and the flange part 103 slides on the rail.

Then, one hand holding the far side grip 96 is released, and the drum unit 21 is pushed in the front-to-rear direction (the horizontal direction) by the other hand holding the near side grip 92.

Then, the drum unit 21 slides in the front-to-rear direction (horizontal direction) as guided by the rail (not shown) until each notch part 112 contacts the reference axial member 125. Thereafter, when each notch part 112 contacts the reference axial member 125, the drum unit 21 is positioned in the main casing 2 as explained later. This completes the mounting of the drum unit 21 in the main casing 2. Subsequently, the other hand holding the near side grip 92 is released, and the front cover 120 is swung to the closed position to close the drum access opening 124.

Note that when the front cover 120 is swung to the closed position, the near side grip 92 is pivotally moved from the down position to the upright position about the support axis member 93.

At this mounting operation, as shown in FIG. 10, each positioning part 94 of the drum unit 21 is inserted from the front end of each metal frame 122 into the groove 134. Each positioning part 94 is guided toward the concave portion 135 by the edges 138A and 138B of the pressing arm 138. Thereafter, the positioning part 94 reaches the concave portion 135 due to the self weight of the drum unit 21 and contacts the contact surface 136 of the concave portion 135. Moreover, the pressing arm 138 contacts the positioning part 94 from the opposite side of the contact surface 136 to sandwich the positioning part 94 with the contact surface 136 and the pressing arm 138.

In the mounted state of the drum unit 21 on the main casing 2 (hereinafter simply referred to as the "mounted state"), as shown in FIG. 11, at the front end of the drum unit 21 (the trailing end in the mounting direction), the pressing member 138 applies a pressing force F to each positioning part 94 in a pressing direction denoted by an arrow F, which is an oblique direction toward the rear-lower side. The pressing force F has both a first component F1 in the front-to-rear direction (the predetermined reference direction) and a second component F2 in the lower direction (a direction perpendicular to the predetermined reference direction). Each positioning part 94 contacts the contact surface 136 that extends in the front-to-rear direction (the predetermined reference direction), and is pressed in the rearward direction by the first component F1.

As described above, in the mounted state, the positioning part 94 (the trailing end in the mounting direction) is pressed in the rearward direction by the first component F1, resulting that the entirety of the drum unit 21 is also pressed in the rearward direction. Accordingly, as shown in FIG. 12, each notch part 112 formed at the rear end on the pair of side plates 101 is pressed rearward in the front-to-rear direction (the direction denoted by the first component F1, i.e., the predetermined reference direction). In this state, the notch part 112 is in contact with the reference axial member 125 at the upper edge 113 (the first contact surface) and the lower edge 114 (the second contact surface), allowing the leading end of the drum unit 21 to be positioned in the first positioning direction S1 and in the second positioning direction S2 (both intersecting the direction denoted by the first component F1) with respect to the reference axial member 125.

In the mounted state, namely, after mounted in the main casing 2, the drum unit 21 is subjected to positioning as mentioned above at the both ends in the width direction of the front end thereof and the both ends in the width direction of the rear end thereof. Hence, flexure and torsion of the front beam 91, the four drum subunits 23, and the rear beam 95 which are sandwiched by the pair of side plates 101 are restricted, and the posture in the mounted state is fixed. In other words, after mounted in the main casing 2, the drum unit 21 takes a rigid structure.

6. Effects of the Illustrative Aspects

In the color laser printer 1, as described above, while in the mounted state, each notch part 112 at the rear end of the drum unit 21 is pressed in the rearward direction F1 (the predetermined reference direction), so that the positioning is performed at the upper edge 113 and the lower edge 114 in the two directions intersecting the rearward direction F1 (the predetermined reference direction). Further, the positioning is performed at the front end (the trailing end) of the drum unit 21 as follows. Each positioning part 94 of the front end of the drum unit 21 contacts the contact surface 136 and is pressed toward the oblique direction F toward the rear-lower side, such that the pressing force F has both a first component F1 in the rearward direction (the predetermined reference direction) and a second component F2 in the lower direction (a direction perpendicular to the predetermined reference direction).

Namely, since the positioning of the rear end is performed in the drum unit 21 such that the reference axial member 125 is sandwiched from the upper and lower directions at each notch part 112, the front end (the trailing end) thereof is positioned on a swing locus L (the dotted line in FIG. 6) swinging in the vertical direction with the reference axial member 125 as the fulcrum. The trailing end is positioned as each positioning part 94 is obliquely pressed toward the rear-lower side (the direction F) by each pressing arm 138, contacting each contact surface 136 extending on the straight line in the front-to-rear direction (the horizontal direction).

Accordingly, the photosensitive drum 24 of each drum subunit 23 is relatively positioned in the front-to-rear direction (the horizontal direction), that is, in the same direction as the direction of the straight line passing through the rotational axes of the drum shafts 28. Thus, all the photosensitive drums 24 can be accurately positioned relative to the scanning unit 17. As a result, through a simple construction, the drum unit 21 can be accurately positioned relative to the main casing 2, thus accomplishing formation of accurate color images.

Further, in the drum unit 21, as the mutually adjacent drum subunits 23 are linked together, there are possibilities that errors in positioning between the photosensitive drums 24 are accumulated. However, by sandwiching the independent drum subunits 23 with the pair of side plates 101, any accumulation of errors in positioning between the photosensitive members 24 are eliminated, thus enabling positioning to be made accurately between the photosensitive drums 24.

In addition, because each drum subunit 23 is independently provided, only the photosensitive drum 24 that is deteriorated can be replaced.

Further, in the drum unit 21, the front beam 91, the four drum subunits 23, and the rear beam 95 are all formed of resin material. On the other hand, the pair of side plates 101 sandwiching these parts are formed of the steel plates of higher rigidity than the resin material. Therefore, the rigidity of the drum unit 21 can be ensured, and in the mounted state, each drum subunit 23 can be accurately and reliably positioned, maintaining the relative positions between the drum subunits 23 with precision.

Further, while the drum unit 21 takes the flexible structure that relatively allows flexure and torsion before mounted in the main casing 2, the drum unit 21 is able to take the rigid structure that fixes the posture in the mounted state after mounted in the main casing 2. This enables the photosensitive drum 24 of each drum subunit 23 to be positioned with more accuracy and reliability.

Further, at the rear end and the front end, the positioning of the drum unit 21 is performed at four locations of each notch part 112 and each positioning part 94 arranged at both ends in the width direction. As a result, in the mounted state, the accurate and reliable positioning can be achieved while correcting skew of the drum unit 21.

Further, as each notch part 112 of the drum unit 21 contacts the reference axial member 125 of the main casing 2, the both ends in the width direction at the rear end of the drum unit 21 are properly positioned. Consequently, through the simple construction, the positioning of the both ends at the rear end of the drum unit 21 can be accomplished with reliability.

Further, the reference axial member 125 is not affected much (i.e., small degradation) by impacts due to repetition of mounting the drum unit 21. Since the reference axial member 125 having such characteristics is provided on the main casing 2, stable positioning over a long period of time can be accomplished.

Moreover, the both ends in the axial direction of the reference axial member 125 of the main casing 2 are inserted into each reference axial member through-hole 126 and urged by each cam plate 131 toward the lower edge and the rear edge of each reference axial member through-hole 126, so that the positioning is executed by making a point contact with each edge. Therefore, the position of the both ends in the axial direction of the reference axial member 125 can be fixed securely at each reference axial member through-hole 126. As a result, the both ends at the rear end of the drum unit 21 can be positioned more reliably.

Further, since each positioning part 94 of the drum unit 21 is pressed with reliability by each pressing arm 138 in the oblique direction F toward the rear-lower side (the direction which intersects both the front-to-rear direction and the vertical direction), the both axial ends at the front end of the drum unit 21 can be securely positioned.

Further, at the support axis member 93 where each positioning part 94 is integrally formed, the near side grip 92 is pivotally supported between the positioning parts 94. Hence, there is no need to provide a member for supporting the near side grip 92. This results in simplifying the apparatus and reducing costs by decreasing the number of parts.

Further, each side plate 101 is formed with the notch part 112 at the rear end thereof, and the positioning part 94 is provided at the front end thereof. Thus, these ends can be reliably positioned at the rear end and the front end of the drum unit 21. Furthermore, the structure can be made simple because the notch part 112 and the positioning part 94 are both provided at the side plate 101.

Further, at the rear end of the drum unit 21, the upper edge 113 of each notch part 112 is formed along the front-to-rear direction (the horizontal direction). Therefore, positional displacement of the rear end of the drum unit 21 upward in the vertical direction relative to the main casing 2 can be restricted. Accordingly, the relative positioning of each photosensitive drum 24 in the front-to-rear direction (the horizontal direction) can be made with more reliability.

Still further, at the rear end of the drum unit 21, each positioning part 94 being pressed by each pressing arm 138 contacts each contact surface 136 extending on the straight line in the front-to-rear direction (horizontal direction). Therefore, positional displacement of the front end of the drum unit 21 in the vertical direction relative to the main casing 2 can be restricted. Accordingly, the relative positioning of each photosensitive drum 24 in the front-to-rear direction (the horizontal direction) can be made with more reliability.

7. Modifications

While the invention has been described in detail with reference to the above aspects thereof, it would be apparent to those skilled in the art that various changes and modifications may be made therein without departing from the spirit of the invention.

In the drum unit 21 of the above-described illustrative aspects, the developer cartridge 22 for each color is separately provided from the drum subunit 23 so that the developer cartridge 22 can be detachably mounted on each drum subunit 23 for each color. However, the developer cartridge 22 and the drum subunit 23 can be provided integrally. In that case, a toner, the developing roller 34, and the photosensitive drum 24 for each color can be replaced all at once only by replacing the drum unit 21.

In the above-described illustrative aspects, there is illustrated a tandem color laser printer 1 which can directly transfer an image from each photosensitive drum 24 to a sheet 3. However, the invention is not limited to this and, for example, may be so constructed as a color laser printer of an intermediate-transfer type which first transfers a toner image for each color from each photosensitive member to an intermediate transfer member, thereafter transferring altogether to the sheet 3.

Figure 13:
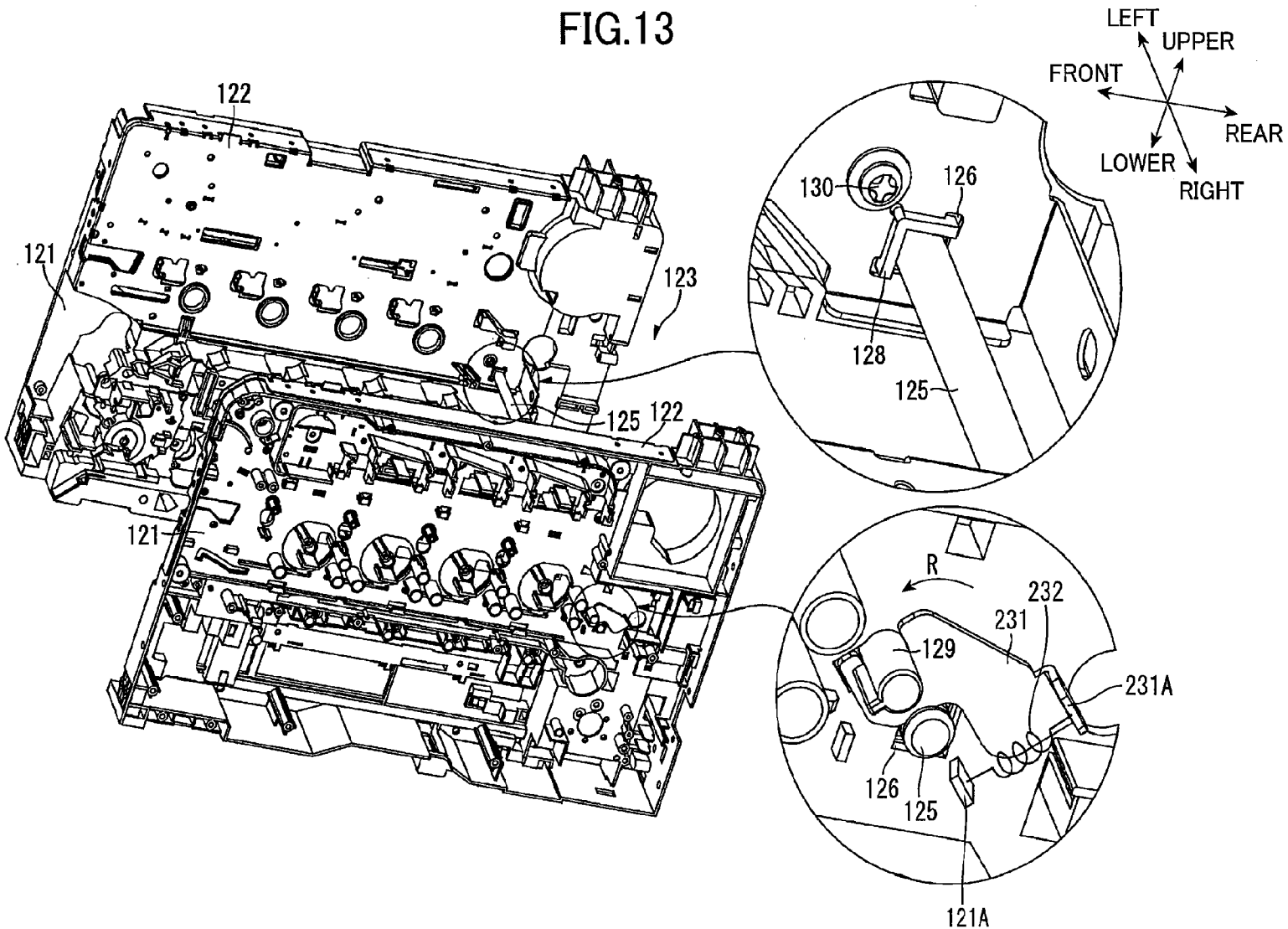
FIG. 13 is a perspective view of a drum accommodating portion according to a modification.

In the above-described illustrative aspects, the cam plate 131 (FIG. 9) is provided on the outside surface of each resin frame 121 to urge the reference axial member 125 and the screw-fixing tube part 129 in a direction away from each other, and the rear end of each cam plate 131 is secured by the fixing screw 132 to the resin frame 121. As shown in FIG. 13, however, a spring 232 (elastic member) may be provided instead of the fixing screw 132. One end of the spring 232 is fixed to a fixing part 121A provided on the outside surface of each resin frame 121. Another end of the spring 232 is fixed to a fixing part 231A of a cam plate 231. The spring 232 is in a compressed state. In this configuration, the spring 232 urges the fixing part 231A in the upper-rearward direction, thereby rotating the cam plate 231 in a direction indicated by an arrow R about the screw-fixing tube part 129. Accordingly, the cam plate 231 urges the reference axial member 125 and the screw-fixing tube part 129 in a direction away from each other, thereby positioning the reference axial member 125 relative to the reference axial member through-hole 126.

The invention claimed is:

1. An image forming apparatus comprising:

a casing;

a shaft extending in an axial direction;

a pressing member provided on the casing; and a photosensitive-member unit configured to move in a moving direction orthogonal to the axial direction, the photosensitive-member unit including:

a photosensitive member having an end in the axial direction; and a side plate having a front end and a rear end in the moving direction, the rear end being formed of a notched portion which is configured to contact the shaft, the side plate including a positioning portion that protrudes from adjacent to the front end and is configured to contact the pressing member.

2. The image forming apparatus according to claim 1, wherein the shaft has an upper part, a lower part, a front part, and a rear part, wherein the notched portion has:

a first edge formed on a straight line substantially extending in a horizontal direction and configured to contact the upper part of the shaft; and a second edge formed on a straight line slanting upward from the rear end to the front end and configured to contact the lower part of the shaft.

3. A photosensitive-member unit comprising:

a photosensitive member having an axis which extends in an axial direction; and a side plate having a first end and a second end in a direction orthogonal to the axial direction, the first end being formed a notched portion, wherein the side plate includes a protruding portion located adjacent to the second end.

4. The photosensitive-member unit according to claim 3, wherein the notched portion has:

a first edge that is formed on a straight line substantially extending in the horizontal direction; and a second edge that is formed on a straight line slanting upward from the first end to the second end.

5. A photosensitive-member unit comprising:

a photosensitive member having a shaft which extends in an axial direction; and a side plate having a first end and a second end in a direction orthogonal to the axial direction, the first end being formed a notched portion, wherein the side plate includes an opening configured for receiving the shaft, wherein the opening is separate from the notched portion.

* * * * *